US011187240B2

(12) United States Patent
Ku et al.

(10) Patent No.: US 11,187,240 B2
(45) Date of Patent: Nov. 30, 2021

(54) BLOWER

(71) Applicant: LG ELECTRONICS INC., Seoul (KR)

(72) Inventors: Myungjin Ku, Seoul (KR); Heechul Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 444 days.

(21) Appl. No.: 16/317,871

(22) PCT Filed: Jul. 19, 2017

(86) PCT No.: PCT/KR2017/007799

§ 371 (c)(1),
(2) Date: Jan. 15, 2019

(87) PCT Pub. No.: WO2018/016883

PCT Pub. Date: Jan. 25, 2018

(65) Prior Publication Data

US 2021/0293250 A1 Sep. 23, 2021

(30) Foreign Application Priority Data

Jul. 20, 2016 (KR) ..... 10-2016-0092153

(51) Int. Cl.
*F04D 27/00* (2006.01)
*F04D 29/42* (2006.01)
(Continued)

(52) U.S. Cl.
CPC ..... *F04D 29/424* (2013.01); *F04D 17/162* (2013.01); *F04D 25/06* (2013.01);
(Continued)

(58) Field of Classification Search
CPC ..... F04D 17/162; F04D 25/08; F04D 25/10; F04D 25/166; F04D 27/004;
(Continued)

(56) References Cited

U.S. PATENT DOCUMENTS 3,421,428 A 1/1969 Baumann et al.
4,738,188 A * 4/1988 Nishida ..... F24F 11/0001 454/229

(Continued)

FOREIGN PATENT DOCUMENTS

EP 3 460 250 3/2019
JP 2012-229657 11/2012

(Continued)

OTHER PUBLICATIONS

European Search Report dated Jan. 3, 2020 issued in Application No. 17831356.5.

(Continued)

*Primary Examiner* — Ninh H. Nguyen
(74) *Attorney, Agent, or Firm* — Ked & Associates LLP

(57) ABSTRACT

The present invention relates to a blower. A blower according to one embodiment of the present invention comprises: an upper fan for generating a first airflow, which is suctioned through an upper suction part and is then discharged; a lower fan disposed under the upper fan to generate a second airflow, which is suctioned through a lower suction part and is then discharged; an airflow changing device disposed between the upper fan and the lower fan to generate a third airflow by joining the first airflow and the second airflow; and a control part for controlling the rotation speed of each of the upper fan and the lower fan to adjust the discharge direction of the third airflow.

20 Claims, 26 Drawing Sheets

(51) Int. Cl.

| | |
|---|---|
| ***F04D 17/16*** | (2006.01) |
| ***F04D 25/06*** | (2006.01) |
| ***F04D 25/08*** | (2006.01) |
| ***F04D 25/16*** | (2006.01) |
| ***F04D 29/28*** | (2006.01) |
| ***F24F 1/0014*** | (2019.01) |

(52) U.S. Cl.
CPC ..... *F04D 25/08* (2013.01); *F04D 25/166* (2013.01); *F04D 27/004* (2013.01); *F04D 29/281* (2013.01); *F24F 1/0014* (2013.01)

(58) Field of Classification Search
CPC ..... F04D 29/4213; F04D 29/424; F04D 29/4246; F04D 29/441; F05D 2270/02; F05D 2270/03
See application file for complete search history.

(56) References Cited

U.S. PATENT DOCUMENTS

| | | | | |
|---|---|---|---|---|
| 5,258,676 | A | 11/1993 | Reinhardt et al. | |
| 5,938,527 | A | 8/1999 | Oshima et al. | |
| 6,030,173 | A * | 2/2000 | Bacchiocchi | F04D 29/424 415/98 |
| 8,562,283 | B2 * | 10/2013 | Hopkins | F24F 11/77 415/61 |
| 11,067,089 | B2 | 7/2021 | Kim et al. | |
| 2004/0018105 | A1 | 1/2004 | Stoddard et al. | |
| 2012/0275915 | A1 | 11/2012 | Konishi et al. | |
| 2015/0337855 | A1 | 11/2015 | Kim | |
| 2017/0089605 | A1 | 3/2017 | Kim et al. | |

FOREIGN PATENT DOCUMENTS

| | | |
|---|---|---|
| KR | 20-1986-0013533 | 11/1986 |
| KR | 10-2000-0055145 | 9/2000 |
| KR | 10-0270787 | 11/2000 |
| KR | 10-2001-0036050 | 5/2001 |
| KR | 10-0323355 | 2/2002 |
| KR | 10-2002-0017126 | 3/2002 |
| KR | 20-0278255 | 6/2002 |
| KR | 10-0379992 | 4/2003 |
| KR | 10-2008-0087365 | 10/2008 |
| KR | 10-0919317 | 10/2009 |
| KR | 10-2012-0022248 | 3/2012 |
| KR | 10-2012-0049182 | 5/2012 |
| KR | 10-2013-0068917 | 6/2013 |
| KR | 10-2016-0034058 | 3/2016 |

OTHER PUBLICATIONS

International Search Report (with English Translation) and Written Opinion dated Nov. 24, 2017 issued in Application No. PCT/KR2017/007799.
U.S. Appl. No. 16/640,123, filed Feb. 19, 2020.

* cited by examiner

BLOWER

CROSS-REFERENCE TO RELATED PATENT APPLICATIONS

This application is a U.S. National Stage Application under 35 U.S.C. § 371 of PCT Application No. PCT/KR2017/007799, filed Jul. 19, 2017, which claims priority to Korean Patent Application No. 10-2016-0092153, filed Jul. 20, 2016, whose entire disclosures are hereby incorporated by reference.

TECHNICAL FIELD

The present invention relates to a blower.

BACKGROUND ART

In general, a blower is understood as a device for sucking air and blowing air to a position desired by a user. Such a blower is mainly disposed in an indoor space such as a home or office, and is mainly used to cool the user by blowing air to the user in hot weather such as in summer.

A conventional blower generally includes a support and a blower. The prior art relating to the conventional blower is as follows.

PRIOR ART

Patent Document

Korean Patent Laid-Open Publication 10-2008-0087365 (Publication date: Oct. 1, 2008, Title of the invention: Electric fan)

The conventional blower disclosed in the above patent document includes a main body having a motor mounted therein, a blade portion coupled to the motor and installed on the main body to be rotated according to operation of the motor, and a support disposed below the main body to support the main body.

In addition, a first safety cover and a second safety cover are coupled at the front side of the main body coupled with the motor and the blade portion is disposed therebetween. The first safety cover and the second safety cover prevent the user from directly contacting the rotating blade portion.

In the conventional blower, when the motor in the main body is driven, the blade portion may rotate to blow air toward the user.

Such a blower has the same configuration as a widely used blower.

However, the conventional blower has the following problems.

First, a user has to arbitrarily change the position of the main body in order to adjust the vertical direction of air blown by the blade portion. That is, the user has to manually adjust the vertical direction.

Second, even when the user manually adjusts the vertical direction of air, air may be blown to only one side. That is, the conventional blower can automatically reciprocate in a horizontal direction, but cannot reciprocate in the vertical direction. Therefore, the user has to arbitrarily adjust the direction.

Third, since the first safety cover and the second safety cover, between which the blade portion is disposed, are generally formed in a grill shape, fine dust or foreign materials in outside air are accumulated on the blade portion. Therefore, when the user uses the blower, the user suffers inconvenience due to dust.

DISCLOSURE

Technical Problem

In order to solve such problems, a blower according to an embodiment of the present invention is disclosed.

An object of the present invention devised to solve the problem lies in a blower capable of adjusting the vertical direction of a third airflow, by controlling the revolutions per minute of an upper or lower fan motor through a controller without manually adjusting a main body in order to discharge air upwardly or downwardly.

Another object of the present invention devised to solve the problem lies in a blower capable of discharging air while reciprocating in a vertical direction.

Another object of the present invention devised to solve the problem lies in a blower having clean appearance without dust accumulated on a fan by minimizing the externally exposed area of the fan for flowing air.

Technical Solution

The object of the present invention can be achieved by providing a blower including an upper fan configured to generate a first airflow sucked through an upper suction part and then discharged, a lower fan provided under the upper fan and configured to generate a second airflow sucked through a lower suction part and then discharged, an airflow changing device disposed between the upper fan and the lower fan and configured to generate a third airflow obtained by combining the first airflow and the second airflow, and a controller configured to control rotation speeds of the upper fan and the lower fan to adjust a discharge direction of the third airflow.

The controller may adjust a vertical discharge direction of the third airflow.

The controller may control the rotation speed of the lower fan to be greater than the rotation speed of the upper fan to direct the third airflow to the upper side of the airflow changing device.

The controller may control the rotation speed of the upper fan to be greater than the rotation speed of the lower fan to direct the third airflow to the lower side of the airflow changing device.

The blower may further include a first discharge part disposed at an outlet side of the upper fan, the first discharge part having a first discharge port, through which the first airflow is discharged to the airflow changing device, and a second discharge part disposed at an outlet side of the lower fan, the second discharge part having a second discharge port, through which the second airflow is discharged to the airflow changing device.

The first discharge port and the second discharge port may be rotatable in a circumferential direction.

The third airflow may be generated when the first discharge port and the second discharge port are aligned in a vertical direction.

The blower may further include an upper fan motor connected to the upper fan, and a lower fan motor connected to the lower fan, and the controller may control revolutions per minute of the upper fan motor and revolutions per minute of the lower fan motor to adjust the vertical discharge direction of the third airflow.

The controller may control the revolutions per minute of the upper fan motor to be greater than the revolutions per minute of the lower fan motor, such that the discharge direction of the third airflow is directed to the upper side of the airflow changing device.

The controller may control the revolutions per minute of the lower fan motor to be greater than the revolutions per minute of the upper fan motor, such that the discharge direction of the third airflow is directed to the lower side of the airflow changing device.

The controller may be capable of increasing or decreasing the revolutions per minute of the upper fan motor at a constant speed within a first set range.

The controller may be capable of increasing or decreasing the revolutions per minute of the lower fan motor at a constant speed within a second set range.

The first set range and the second set range may form the same range.

The controller may increase or decrease the revolutions per minute of the upper fan motor and the revolutions per minute of the lower fan motor to be inversely proportional to each other, such that the third airflow is discharged reciprocating between the upper and lower sides of the airflow changing device.

A sum of the revolutions per minute of the upper fan motor and the revolutions per minute of the lower fan motor may be constant.

The controller may perform control such that the third airflow is discharged from the upper side to the lower side of the airflow changing device, by first reciprocating operation of increasing the revolutions per minute of the upper fan motor at a constant speed and decreasing the revolutions per minute of the lower fan motor at a constant speed.

The controller may perform control such that the third airflow is discharged from the lower side to the upper side of the airflow changing device, by second reciprocating operation of decreasing the revolutions per minute of the upper fan motor at a constant speed and increasing the revolutions per minute of the lower fan motor at a constant speed.

The first reciprocating operation and the second reciprocating operation are alternately performed.

As the revolutions per minute of the upper fan motor or the revolutions per minute of the lower fan motor increases, a discharge intensity of the third airflow may increase.

The blower may further include a support device supporting a main body to be spaced apart upwardly from the ground at a predetermined distance.

Advantageous Effects

The blower according to the embodiments of the present invention having the configuration has the following effects.

First, the user can conveniently adjust the vertical direction of discharged air, by controlling the revolutions per minute of the upper or lower fan motor through the controller.

Second, the user can perform control such that air discharged from the blower is discharged while reciprocating in the vertical direction, thereby efficiently performing ventilation or efficiently blowing air of an internal space in which the blower is provided.

Third, dust is not accumulated on the fan in the blower and the appearance of the blower is clean.

BEST MODE

Hereinafter, exemplary embodiments of the present invention will be described in detail with reference to the accompanying drawings, which will be readily apparent to those skilled in the art to which the present invention pertains. The present invention may be embodied in many different forms and is not limited to the structures and methods described herein.

It will be understood that, although the terms first, second, A, B, (a), (b), etc. may be used herein to describe various elements of the present invention, these terms are only used to distinguish one element from another element and essential, order, or sequence of corresponding elements are not limited by these terms.

Figure 1:
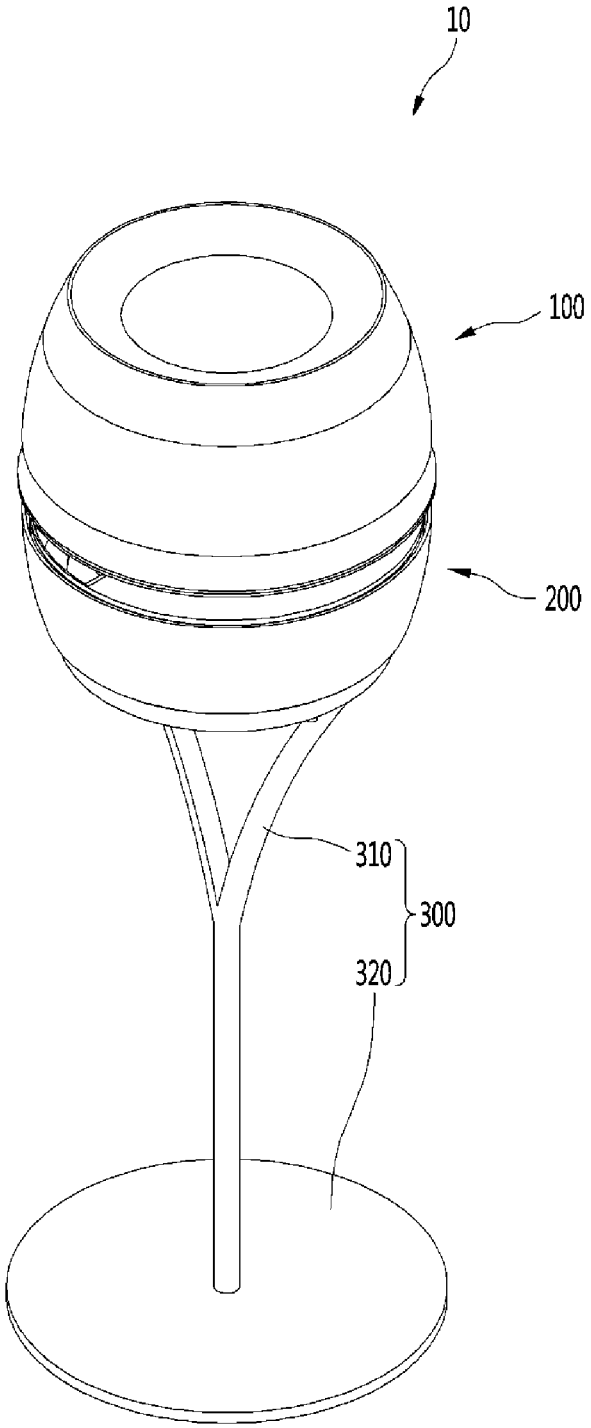
FIG. 1 is a perspective view of a blower according to an embodiment of the present invention.
Figure 2:
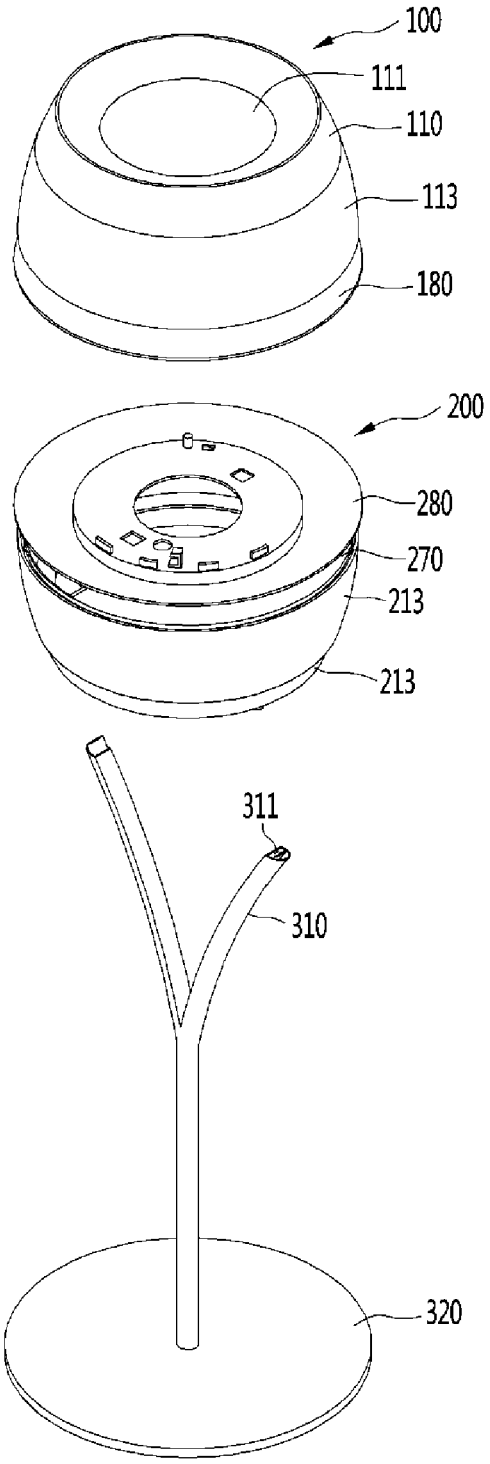
FIG. 2 is an exploded view of a blower according to an embodiment of the present invention.

FIG. 1 is a perspective view of a blower according to an embodiment of the present invention, and FIG. 2 is an exploded view of a blower according to an embodiment of the present invention.

Referring to FIGS. 1 and 2, the blower according to the embodiment of the present invention may include a main body for generating an air flow and a support device 300 supporting the main body. The main body 10 may include a first blowing device 100 for generating a first airflow A (see FIG. 21) and a second blowing device 200 for generating a second airflow B (see FIG. 21).

Specifically, the first blowing device 100 and the second blowing device 200 may be arranged in a vertical direction. In one embodiment, the first blowing device 100 may be provided above the second blowing device 200. In this case, the first airflow A may be flow of indoor air sucked from the upper side of the main body 10, that is, the first blowing device 100, and discharged to the outside of the central portion of the first blowing device 100, and the second airflow may be flow of indoor air sucked from the lower side of the main body 10, that is, the second blowing device, 200, and discharged to the outside of the central portion of the second blowing device 200.

In addition, the first blowing device 100 and the second blowing device 200 may be disposed to be vertically symmetrical with respect to the same central axis and may be disposed to rotate about the central axis. The central axis is a virtual line connecting the centers of the first blowing device 100 and the second blow device 200 in order to set a direction, and is not a real configuration.

The appearance of the first blowing device 100 and the appearance of the second blowing device 200 may have the same shape. In this case, the first blowing device 100 and the second blowing device 200 may be disposed to be symmetrical with respect to the vertical central axis.

The first blowing device 100 may suck indoor air from the upper side of the main body 10 and discharge the indoor air at a lower end in a first discharge direction to generate the first airflow A and the second blowing device 200 may suck indoor air from the lower side of the main body 10 and discharge the indoor air at an upper end in a second discharge direction to generate the second airflow B.

The discharge direction of the first airflow A and the discharge direction of the second airflow B may be equal to or different from each other according to the rotation directions of the first blowing device 100 and the second blowing device 200.

As an operation example, when the first blowing device 100 and the second blowing device 200 rotate in one direction, the discharge direction of the first airflow A and the discharge direction of the second airflow B may be the same. That is, if the discharge direction of the first airflow A is the front side of the main body 10, the discharge direction of the second airflow B may be the front side of the main body.

Figure 21:
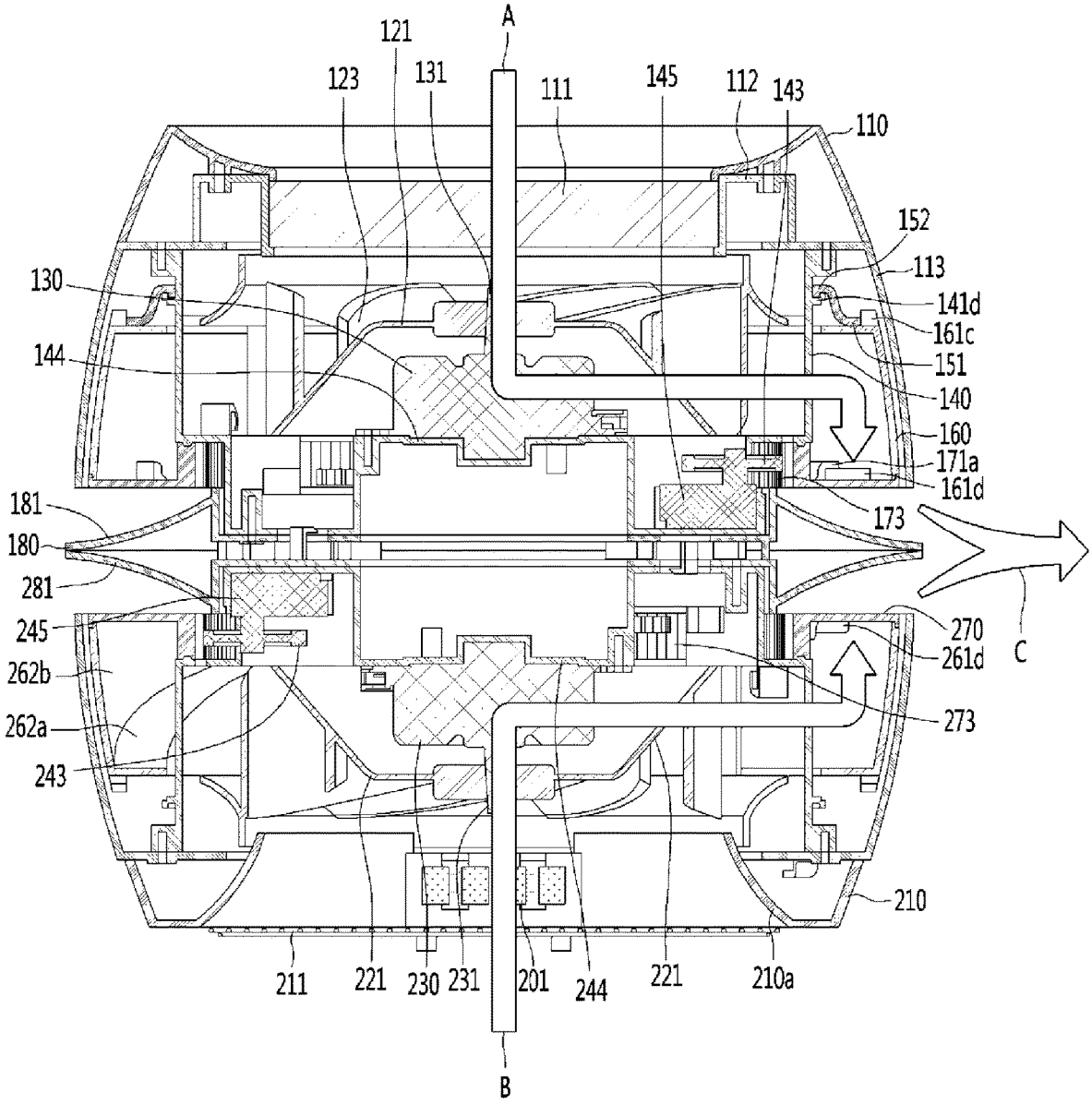
FIG. 21 is a view showing an airflow generated in a blower according to an embodiment of the present invention.

In addition, the first airflow A and the second airflow B may be combined to form a third airflow C (see FIG. 21). The third airflow C may be referred to as the "discharge airflow" of the first and second airflows A and B. The vertical direction of the discharge airflow C may be determined according to the discharge intensities of the first airflow A and the second airflow B. This will be described below in detail.

As another operation example, when the first blowing device 100 rotates in one direction and the second blowing device 200 rotates in the other direction, the discharge direction of the first airflow A and the discharge direction of the second airflow B may be different from each other, that is, opposed to each other. That is, if the discharge direction of the first airflow A is the front side of the main body 10, the discharge direction of the second airflow B may be the rear side of the main body.

The upward operation, the downward operation and the reciprocating operation may be performed only the discharge directions of the first airflow A and the second airflow B are the same. This is because the vertical direction of the third airflow C formed by discharging the first airflow A and the second airflow B in the same direction is determined according to the discharge intensities of the first airflow A and the second airflow B. This will be described below in detail.

The support part 300 may be disposed below the main body 10 to support the main body 10. Specifically, the support part 300 may include a first support part 310 connected to the lower side of the main body 10 to support the main body 10 and a plate-shaped second support part 320 connected to the lower end of the first support part 310 and disposed horizontally with respect to the ground.

The first support part 310 may extend from the main body 10 to the second support part 320. Specifically, the first support part 310 may be an Y-shaped pipe. In this case, the upper portion of the Y-shaped pipe may be connected to the lower end of the main body 10 and the lower portion of the Y-shaped pipe may be connected to the base.

In addition, a wire reception space 311, in which a wire is received, may be formed in the first support part 310. For example, a plurality of wires may be provided. Specifically, the first support part 310 may be a pipe having the wire reception space 311 formed therein, and the wire connected to the main body 10 may be introduced into the second support part 320 through the wire reception space 311 of the first support part 310. The plurality of wires may connect the main body 10 with a controller. The detailed configuration of the controller will be described.

The second support part 320 may be connected to the lower end of the first support part 310 and may be horizontally seated on the ground to support the main body 10. That is, the second support part 320 may function as a "base" disposed horizontally with respect to the ground.

The controller for controlling operation of the main body 10 may be received in second support part 320. In this case, one end of the plurality of wires may be connected to the main body 10 to be disposed in the wire reception space 311 of the first support part 310, and the other end thereof may be introduced into the second support part 320 to be connected to the controller disposed in the second support part 320. By such a connection structure, the plurality of wires may connect the main body 10 with the controller. That is, in the blower according to the embodiment of the present invention, the controller and the wires are received in the support part 300, thereby maintaining the small size of the main body 10.

Hereinafter, the configuration of the main body 10 of the blower according to the embodiment of the present invention will be described in detail.

Figure 3:
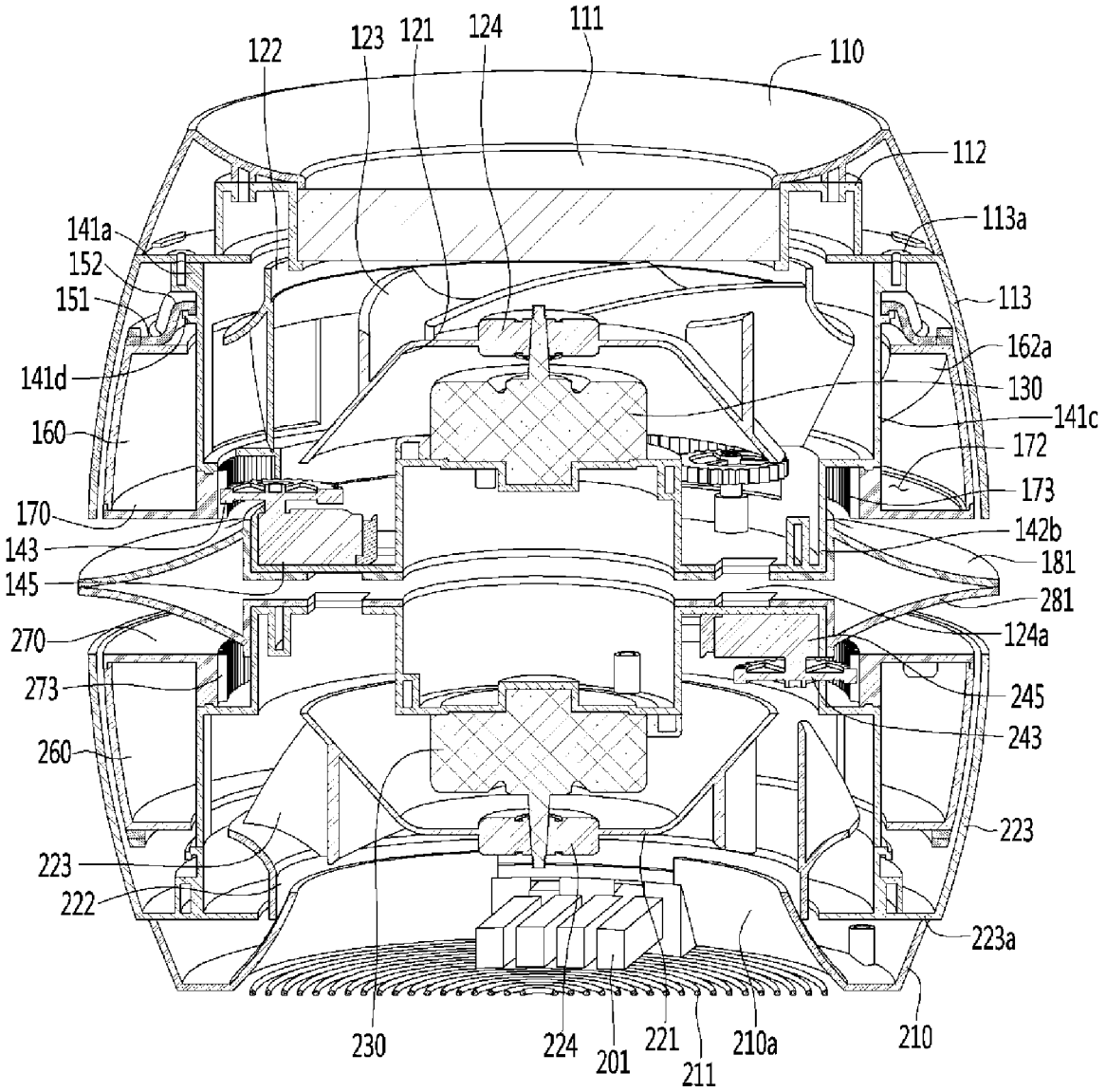
FIG. 3 is a cross-sectional view of a main body of a blower according to an embodiment of the present invention.
Figure 4:
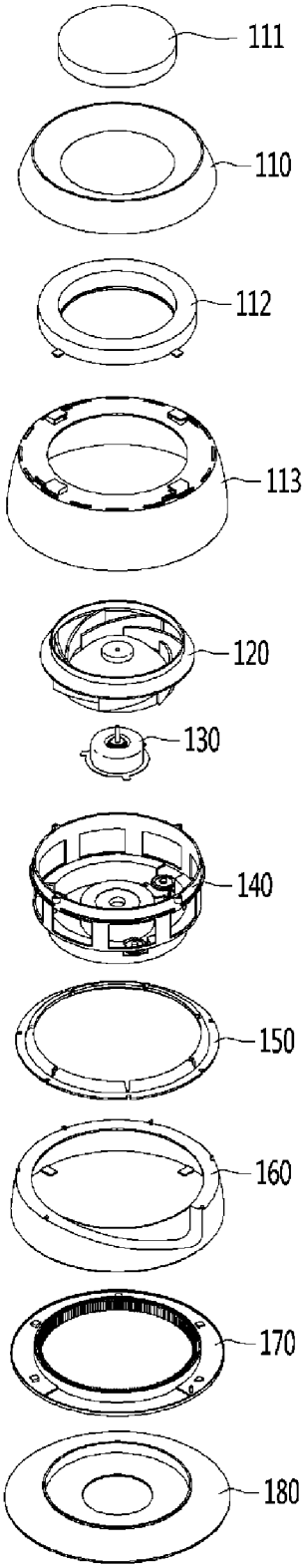
FIG. 4 is an exploded view of a first blowing device according to an embodiment of the present invention.
Figure 5:
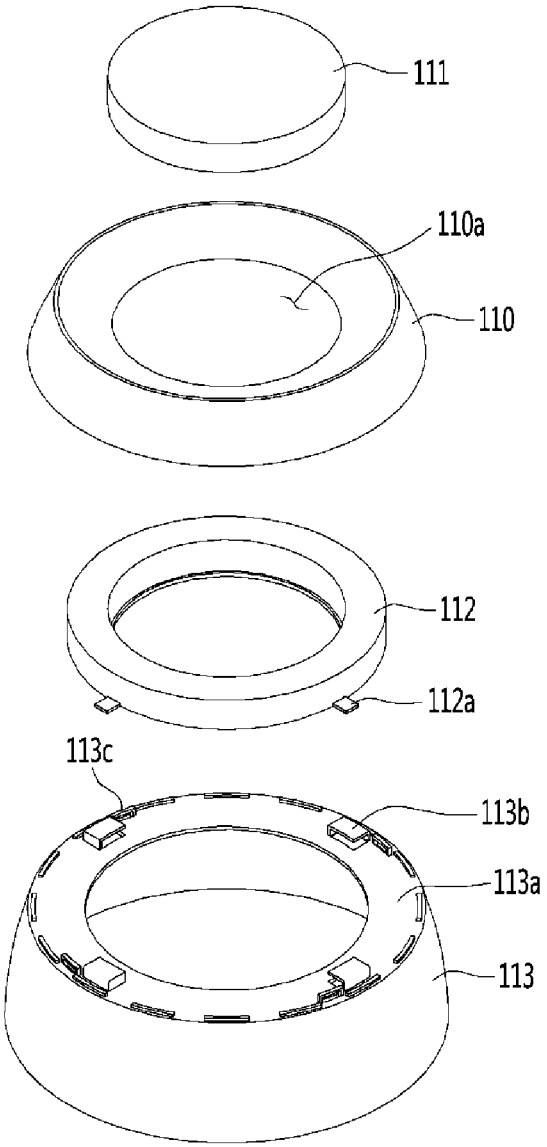
FIG. 5 is an exploded view of an upper suction part and a first case according to an embodiment of the present invention.
Figure 6:
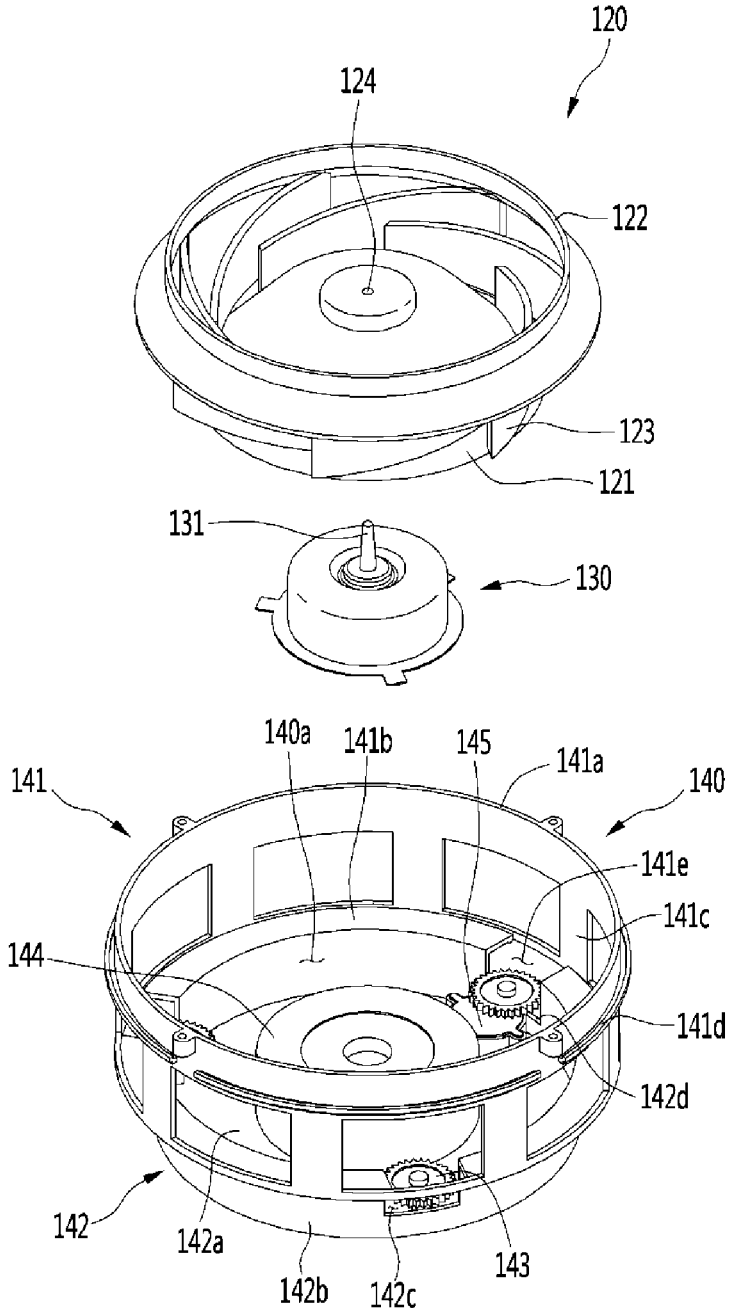
FIG. 6 is an exploded view of a first flow generator according to an embodiment of the present invention.
Figure 7:
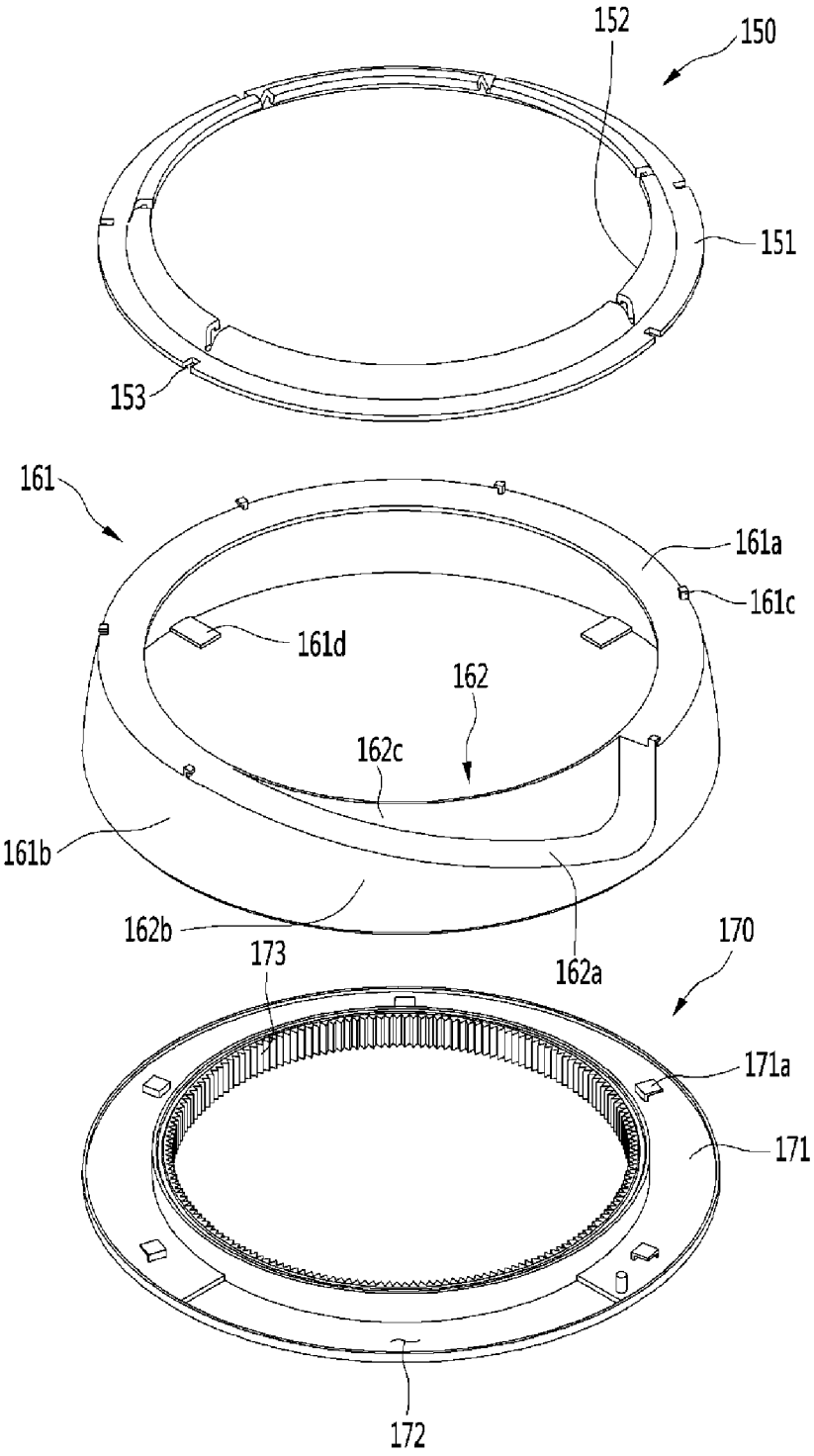
FIG. 7 is an exploded view of a first discharge guide device according to an embodiment of the present invention.
Figure 8:
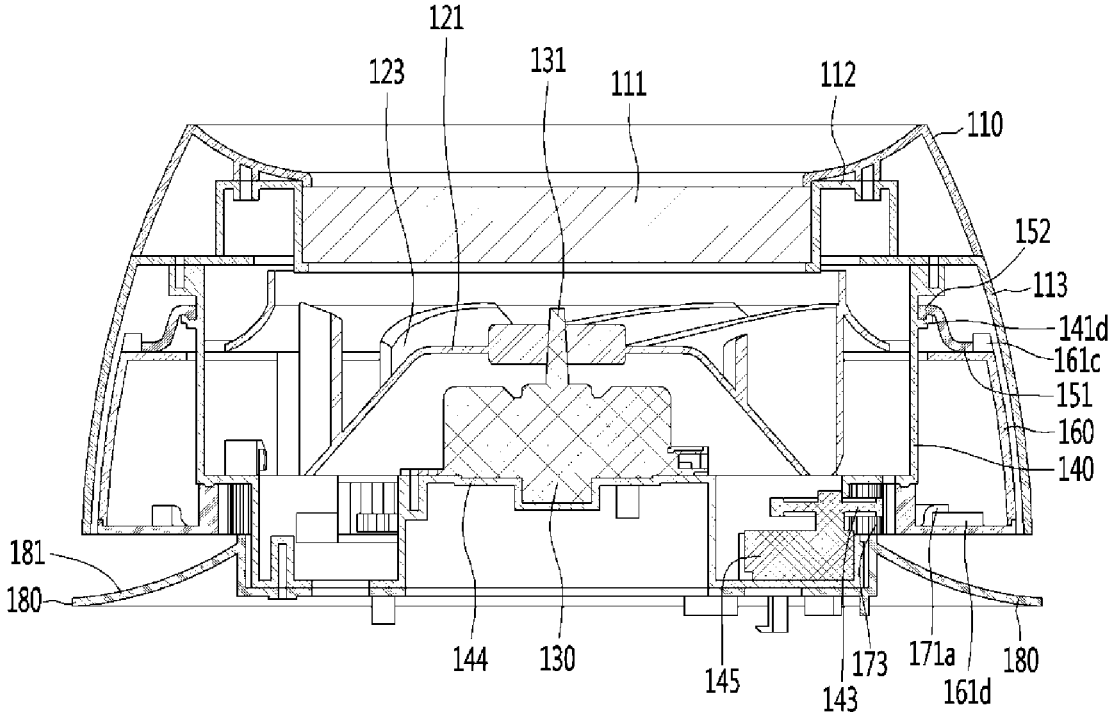
FIG. 8 is a cross-sectional view of a first blowing device according to an embodiment of the present invention.
Figure 9:
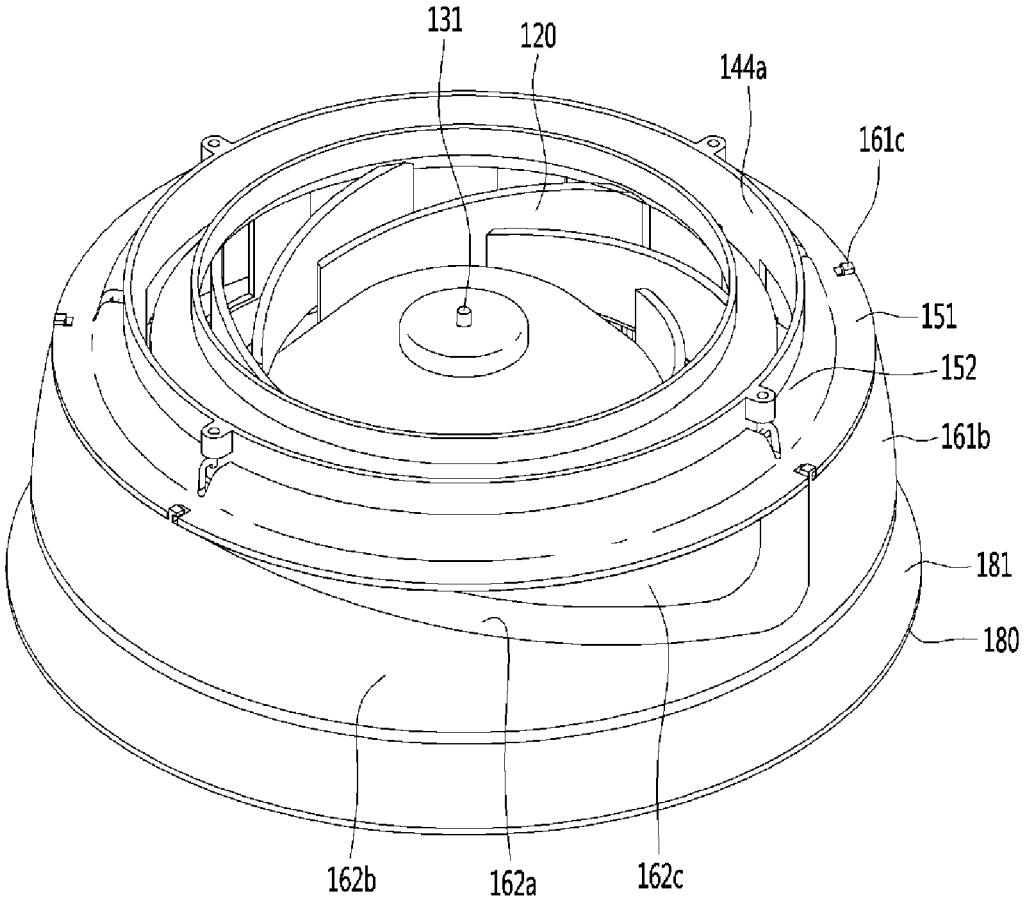
FIG. 9 is a perspective view of a first blowing device according to an embodiment of the present invention, from which a first case and an upper suction part are removed.

FIG. 3 is a cross-sectional view of a main body of a blower according to an embodiment of the present invention, FIG. 4 is an exploded view of a first blowing device according to an embodiment of the present invention, FIG. 5 is an exploded view of an upper suction part and a first case according to an embodiment of the present invention, FIG. 6 is an exploded view of a first flow generator according to an embodiment of the present invention, FIG. 7 is an exploded view of a first discharge guide device according to an embodiment of the present invention, FIG. 8 is a cross-sectional view of a first blowing device according to an embodiment of the present invention, and FIG. 9 is a perspective view of a first blowing device according to an embodiment of the present invention, from which a first case and an upper suction part are removed.

Referring to FIGS. 3 to 9, the main body 10 may include the first blowing device 100 and the second blowing device 200, as described above. The first blowing device 100 may be a means capable of sucking air from the upper side of the main body 10 and discharging the sucked air in a first discharge direction of the lower end.

The first blowing device 100 may include an upper suction part 110 disposed at an upper portion thereof to suck indoor air from above. The upper suction part 110 may include a first suction opening 110*a* formed in a substantially ring shape to suck air. In addition, the upper portion of the upper suction part 110 may have a smaller diameter than the lower portion thereof. That is, the upper suction part 110 may have a truncated cone shape.

The height of the outer circumferential surface of the upper suction part 110 may be greater than that of the inner circumferential surface thereof. That is, an extension extending from the outer circumferential surface to the inner circumferential surface of the upper suction part 110 may be rounded downward. Therefore, since air located at the upper side of the first blowing device 100 may flow along the rounded inclined surface of the upper suction part 110, the suction force of the upper suction part 110 may increase.

A filter mounting part 112, on which a filter is mounted, may be disposed at the inner circumferential side of the upper suction part 110. More specifically, the filter mounting part 112 may have a substantially ring shape and may have a filter mounting opening formed in the central portion thereof. In this case, the size of the filter mounting opening may be substantially equal to that of the first suction opening 110*a* of the upper suction part 110.

The filter 111 may be formed in a circular shape to have a diameter corresponding to the diameter of the filter mounting opening and fitted into the filter mounting opening. That is, the filter 111 is disposed in the first suction opening 110*a*, and air introduced through the upper suction part 110 is filtered by the filter 111 to remove fine dust or foreign material from the air. There is no limitation on the type of the filter 111.

A plurality of first protrusion ribs 112*a* protruding from the center of the filter mounting part 112 in a radial direction may be provided on the outer surface of the filter mounting part 112. The plurality of first protrusion ribs 112*a* may be spaced apart from each other at a constant interval along the circumferential surface of the filter mounting part 112. The first protrusion ribs 112*a* may be coupled to first bent ribs 113*b* formed on the upper surface 113*a* of a first case 113 which will be described below.

The first blowing device 100 may further include the first case 113 coupled to the lower portion of the upper suction part 110 to form the appearance thereof. Specifically, the first case 113 may have a substantially ring shape and the diameter of the upper portion of the first case 113 may be equal to that of the lower portion of the upper suction part 110. In addition, the diameter of the lower portion of the first case 113 may be greater than that of the upper portion of the first case 113.

The first case 113 may have the upper surface 113*a* and the lower surface formed to have a constant width between the outer circumferential surface and the inner circumferential surface thereof. The lower surface of the upper suction part 110 is coupled to the upper surface 113*a* of the first case 113, such that the upper suction part 110 and the first case 113 form an integral shape. In addition, the extension from the upper portion to the lower portion of the first case 113 may be formed to have a predetermined curvature.

In addition, the first bent ribs 113*b* may be formed on the upper surface 113*a* of the first case 113. The plurality of first bent ribs 113*b* may be coupled to the plurality of first protrusion ribs 112*a* formed on the filter mounting part 112.

Specifically, each first bent rib 113*b* may have a "ㄱ" shape. In this case, in order to couple the filter mounting part 112 to the first case 113, when the filter mounting part 112 is disposed on the upper surface of the first case 113 and then is rotated, the first protruding ribs 112*a* may be fitted into the first bent ribs 113*b*.

In addition, a plurality of protrusion ribs 113*c* may be formed on the upper surface 113*a* of the first case 113. In addition, a plurality of coupling grooves, to which the plurality of protrusion ribs 113*c* is capable of being coupled, may be formed in the lower surface of the upper suction part 110. By fitting the plurality of second protrusion ribs 113*c* into the plurality of coupling grooves, it is possible to couple the upper surface of the first case 113 with the lower surface of the upper suction part 110.

A first flow generator may be provided at the inner circumferential surface side of the first case 113. Specifically, the first flow generator may be understood as a means for generating flow of air sucked into the upper suction part 110 and flow of air discharged to the first discharge guide device.

The first flow generator will be described in detail.

The first flow generator may include an upper fan 120 that rotates, an upper fan motor 130 for transmitting rotational force to the upper fan 120, and an upper fan housing 140 in which the upper fan 120 and the upper fan motor 130 are received.

The upper fan motor 130 may be coupled to the upper fan housing 140 to transmit drive force to the upper fan 120. Specifically, the upper fan motor 130 has a rotation shaft coupled to the upper fan 120 to rotate the upper fan 120. The configuration of the upper fan motor 130 is not limited as long as the motor is capable of being coupled to the fan.

The upper fan 120 may be coupled to the upper fan motor 130 to rotate. For example, the upper fan 120 may include a centrifugal fan for introducing air in an axial direction and discharging air to be inclined in a downward radial direction.

Specifically, the upper fan 120 may include a hub 121 coupled to the rotation shaft 131 of the upper fan motor 130, a shroud 122 spaced apart from the hub 121, and a plurality of blades 123 disposed between the hub 121 and the shroud 122.

The hub 121 may have a shape of a bowl which gradually becomes narrower upward. In addition, the hub 121 may include an axial coupling part 131, to which the rotation shaft 131 is capable of being coupled, and a first blade coupling part extending from the axial coupling part 124 downward. In addition, the upper fan motor 130 is disposed in the lower internal space of the hub 121, and the rotation shaft 131 of the upper fan motor 130 may be coupled to the axial coupling part 124 of the hub 121.

The shroud 122 may include an upper end having formed therein a shroud suction port, through which air passing through the upper suction part 110 is sucked, and a second blade coupling part extending from the upper end downward.

One surface of each blade 123 may be coupled to the first blade coupling part of the hub and the other surface thereof may be coupled to the second blade coupling part of the shroud 122. In addition, the plurality of blades 123 may be spaced apart from each other in the circumferential direction of the hub 121.

Each blade 123 may include a leading edge forming a side end, through which air is introduced, and a trailing edge, through which air is discharged. Air sucked through the upper suction part 110 and passing through the filter 111 flows downward and flows in the axial direction of the upper fan 120 to be introduced through the leading edge and to be discharged through the trailing edge of each blade.

At this time, the trailing edge may extend to be inclined outward and downward in the axial direction in correspondence with the air flow direction such that air discharged through the trailing edge obliquely flows in the downward radial direction.

The upper fan housing 140 may include a first coupling fan housing 142, in which the upper fan 120 and the upper fan motor 130 are received, and a first side fan housing 141 disposed above the first coupling fan housing 142. A reception space 140*a*, in which the upper fan 120 and the upper fan motor 130 are received, may be defined by the first coupling fan housing 142 and the first side fan housing 141.

The first side fan housing 141 may include a first upper surface part 141*a* having a ring shape and disposed at the upper portion thereof, a first lower surface part 141*b* having a ring shape and disposed at the lower portion thereof, and a plurality of first extensions 141*c* extending from the first upper surface portion 141*a* to the first lower surface portion 141*b*.

The first upper surface portion 141*a* may have a ring shape and have a surface perpendicular to the ground. That is, the first upper surface portion 141*a* may have a cylindrical shape and the upper and lower ends thereof are opened.

The outer circumferential surface of the first upper surface portion 141*a* may include second bent ribs 141*d* extending by a predetermined length in the circumferential direction. Each second bent rib 141*d* may have a "ㄴ" shape protruding outward in a radial direction of the first upper surface portion 141*a* and then bent upwardly. In addition, the second bent ribs 141*d* may extend in the circumferential direction of the first upper surface portion 141*a*. By this configuration, a guide support device 150 which will be described below may rotate in a state of being coupled to the second bent ribs 141*d* of the first upper surface portion 141*a*.

The first extensions 141*c* vertically extend from the first upper surface portion 141*a* to the first lower surface part 141*b* and may have a plate shape. The plurality of first extensions 141*c* may be spaced apart from each other at a predetermined interval in the circumferential direction of the first side fan housing 141.

The first lower surface part 141*b* may have a ring shape and may include a first lower surface part main body formed to have a surface horizontal with respect to the ground and a plurality of first recessed part 141*e* recessed from the inner circumferential surface of the first lower surface part main body in the radial direction. Specifically, the plurality of first recessed parts 141 may be spaced apart from each other at a predetermined interval in the circumferential direction of the first lower surface part main body.

The first coupling fan housing 142 may be connected to the lower portion of the first side fan housing 141 and may have a cylindrical shape with an opened upper portion. Specifically, the first coupling fan housing 142 may include a first side surface part 142*b*, a second lower surface part 142*a* and an upper fan motor coupling part 144.

The first side surface part 142*b* may extend downwardly from the first lower surface portion 141*b* of the first side fan housing 141. Specifically, the first side surface part 142*b* may have a ring shape with a surface perpendicular to the ground and may include a first side surface part main body extending downwardly from the inner circumferential surface of the first lower surface part 141*b* and second recessed parts 142*c* recessed downwardly from the upper end of the first side surface part main body.

The plurality of second recessed parts 142*c* may be spaced apart from each other at a predetermined interval in the circumferential direction of the main body of the first side surface part 142*b*. The first recessed parts 141*e* and the second recessed parts 142*c* may be vertically communicated to form a communication space. The first pinion gear 143 which will be described below may be partially exposed to the outside of the upper fan housing 140 through the communication space.

In addition, the first side surface part main body may include a first pinion gear coupling surface 142*d* extending from the lower end of the second recessed part 142*c* in the center direction to be coupled with the first pinion gear 143. The first pinion gear coupling surface 142*d* may have a surface parallel to the first lower surface part main body.

When the first pinion gear 143 is coupled to the first pinion gear coupling surface 142*d*, a portion of the first pinion gear 143 may protrude to the outside of the first side surface part main body of the upper fan housing 140 through the communication space of the first recessed parts 141*e* and the second recessed parts 142*c*.

The first pinion gear 143 may be coupled to the first pinion gear coupling surface 142*d*. The first pinion gear 143 is engaged with a first rack gear 173 of a first discharging part 170 which will be described below, and operation thereof will be described below.

For example, the first recessed parts 141*e* and the second recessed parts 142*c* may be arranged in the radial direction of the center of the upper fan housing 140 and the number thereof may be three. In this case, the number of first pinion gears 143 may also be three. In this case, the three first pinion gears 143 may have the same center as the circle which is the upper end surface of the upper fan housing 140 and may be arranged at the vertexes of an equilateral triangle having vertexes on the circumferential surface of the circle of the upper end surface.

The second lower surface part 142*a* may be connected to the lower end of the first side surface part 142*b* to form the lower surface of the upper fan housing 140. The upper fan motor coupling part 144 may protrude upwardly from the center of the second lower surface part 142*a*, and the upper fan motor 130 may be coupled to the upper fan motor coupling part 144.

A first gear motor 145 for transmitting drive force for rotating the first pinion gear 143 may be disposed on the second lower surface 142*a*.

The first blowing device 100 may further include a first discharge guide device disposed between the first flow generator and the first case 113 to rotate in order to guide and discharge the first airflow A generated by the first flow generator to the outside.

The first discharge guide device may include a first flow guide part 160 for guiding the flow of air generated by the first flow generator and a first discharging part 170 disposed below the first flow guide part 160 to discharge air guided by the first flow guide part 160 to the outside. The first discharge guide device may be rotatably connected to the first flow generator to rotate in the circumferential direction.

The first flow guide part 160 may have a ring shape. The diameter of the upper end of the first flow guide part 160 may be less than that of the lower end of the first flow guide part 160. That is, the first flow guide part 160 may have a truncated cone shape.

The first flow guide part 160 may guide air flowing by the upper fan 120. The first flow guide part 160 may include a first airflow guide part 161 for providing a passage, through which air generated by the first flow generator flows, and a second airflow guide part 162 for obliquely and downwardly guiding flow of air from the first airflow guide part 161.

The first airflow guide part 161 may have a C shape obtained by cutting out a portion of a ring shape. Specifically, in the first airflow guide part 161, a side surface 161*b* forming appearance thereof and an upper surface 161*a* bent from the upper end of the side surface 161*b* in the center direction may be formed. A flow passage, through which air may flow, may be formed in a space between the side surface 161*b* and the upper surface 161*a* of the first airflow guide part 161. That is, the side surface of the first airflow guide part 161 may have a "ㄱ" shape.

The second airflow guide part 162 may be disposed in the cut-out portion of the first airflow guide part 161. Specifically, the second airflow guide part 162 may include a first inclined surface 162*a* obliquely rounded downwardly from the upper surface of the first airflow guide part 161 and a first guide connection part 162*b* extending from the side surface of the first airflow guide part 161 and bent downwardly from one end of the first inclined surface 162*a*. In addition, the second airflow guide part 162 may further include a second guide connection part 162*c* bent upwardly from the other end of the first inclined surface 162*a*.

An inclined space formed by the first guide connection part 162*b*, the first inclined surface 162*a* and the second guide connection part 162*c* forms an air flow passage. Air flowing through the first airflow guide part 161 may be guided to the first discharging part 170 through the flow passage formed by the first guide connection part 162*b*, the first inclined surface 162*a* and the second guide connection part 162*c*.

Third bent ribs 161*c* may be formed on the upper surface of the first airflow guide part 161. The third bent ribs 161*c* is understood as a part coupled with a guide support device 150 which will be described below. Specifically, the third bent ribs 161*c* may have a "ㄱ" shape and may be disposed on the upper surface of the first airflow guide part 161. The plurality of third bent ribs 161*c* may be provided. The plurality of third bent ribs 161*c* may be spaced apart from each other at a predetermined interval in the circumferential direction of the first airflow guide part 161.

In addition, third protrusion ribs 161*d* protruding in the center direction may be formed on the side lower end of the first airflow guide part 161. The third protruding ribs 161*d* are understood as parts coupled with the third discharging part. The plurality of third protruding ribs 161*d* may be provided. In this case, the plurality of third protruding ribs 161*d* may be spaced apart from each other at a predetermined interval in the circumferential direction of the first airflow guide part 161.

The first discharging part 170 may be disposed below the first flow guide part 160 to discharge the air guided from the first flow passage guide part to the outside. The first discharging part 170 may include a first discharging part main body 171 having a ring shape and a first rack gear 173 protruding upwardly from the first discharging part main body 171.

Specifically, the first discharging part main body 171 has a ring shape and includes a first discharging port 172 formed by a set length in the circumferential direction. In this case, the set length of the first discharging port 172 may be substantially equal to the length of the second airflow guide part 162. The air guided through the second airflow guide part 162 of the first flow guide part 160 may be discharged downwardly through the first discharging port 172.

Fourth bent ribs 171*a* may be formed on the upper surface of the first discharging part main body 171. Specifically, the fourth bent ribs 171*a* may be bent in a "ㄱ" shape and the plurality of fourth bent ribs 171*a* may be provided. The plurality of fourth bent ribs 171*a* may be spaced apart from each other at a predetermined interval in the circumferential direction of the first discharging part main body 171.

When the first flow guide part 160 is seated in the first discharging part main body 171 and then is rotated, the third protruding ribs 161*d* on the lower surface of the third the first airflow guide part 161 may be inserted into the fourth bent ribs 171*a* of the first discharging part main body 171 to couple the first flow guide part 160 to the first discharging part 170.

The second airflow guide part 162 of the first flow guide part 160 and the first discharging port 172 are vertically disposed, and the flow passage formed in the second airflow guide part 162 may communicate with the first discharging port 172. Therefore, the air guided through the second airflow guide part 162 may be discharged to the outside through the first discharging port 172.

The first rack gear 173 may have a ring shape protruding upwardly from the inner circumferential surface of the first discharging part main body 171. A plurality of saw-teeth extending in the circumferential direction may be provided on the inner circumferential surface of the first rack gear 173.

The first discharge guide device may further include a guide support device 150 supporting the first flow guide part 160.

The guide support device 150 may have a substantially ring shape and may be coupled to that the first flow guide part 160 and the upper fan housing 140 to support the first flow guide part 160 so as to prevent the first flow guide part 160 from being detached downward.

The guide support device 150 may include a seating part 151 seated in the first flow guide part 160 and a coupling part 152 extending upwardly from the seating part 151 and having an end bent downwardly to be coupled to the upper fan housing 140.

The seating part 151 has a ring shape and may include a lower surface seated on the upper surface the first flow guide part 160. In addition, the seating part 151 may have a plurality of coupling grooves 153 spaced apart from each other in the circumferential direction.

When the seating part 151 is seated on the upper surface of the first flow guide part 160 such that the third bent ribs 161*c* are inserted into the second coupling grooves 153 and then the guide support device 150 is rotated, at least a portion of the seating part 151 may be inserted into the third bent ribs 161*c* and thus the guide support device 150 may be coupled to the upper surface of the first flow guide part 160.

The coupling part 152 has a ring shape and may protrude upwardly from the inner circumferential surface of the seating part 151 and then be bent downwardly. That is, one side of the bent coupling part 152 may have a hook. When the coupling part 152 is coupled to the second bent ribs 141*d*, the guide support device 150 may be coupled to the upper fan housing 140.

Since the extension direction of the coupling part 152 and the extension direction of the second bent ribs 141*d* may form the circumferential direction, when the first flow guide part 160 is rotated, the coupling part 152 may be rotated in the extension direction of the second bent rib 141*d*.

Since the diameter of the first blowing device 100 is gradually increased from the upper portion to the lower portion thereof, the first discharge guide device may be detached downward or the position thereof may be deviated. Accordingly, the first discharge guide device is rotatably coupled to the upper fan housing 140 using the guide support device 150, thereby preventing the first discharge guide device from being detached downward or the position thereof from being deviated.

The first blowing device 100 may further include a first airflow changing device 180 disposed below the first discharge guide device to change flow of air discharged from the first discharge guide device in a lateral direction.

The first airflow changing device 180 may have a ring shape and may include an inclined surface inclined downwardly toward the outside at the upper surface thereof. Accordingly, the flow direction of the air discharged downwardly from the first discharge guide device may be changed to the lateral direction by the inclined surface of the first airflow changing device 180.

Hereinafter, the rotation configuration of the first discharge guide device will be described in detail.

Figure 10:
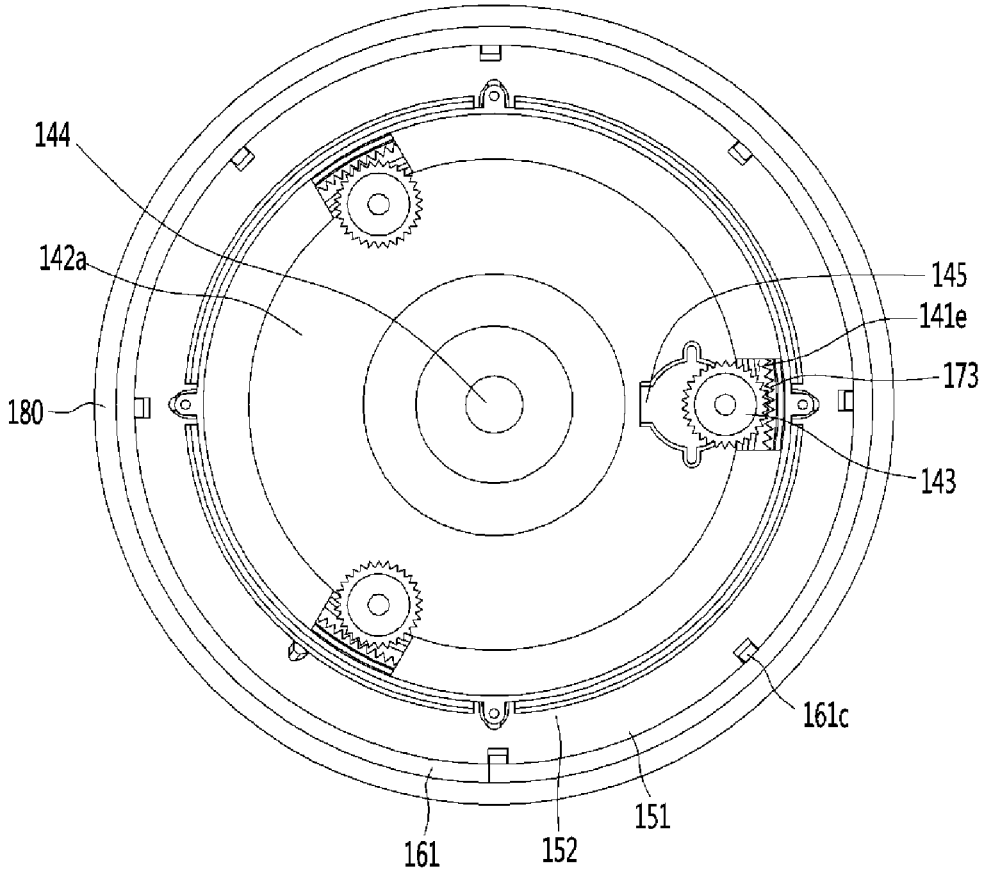
FIG. 10 is a top view showing the coupling state of a first pinion gear and a first rack gear of a first blowing device according to an embodiment of the present invention.
Figure 11:
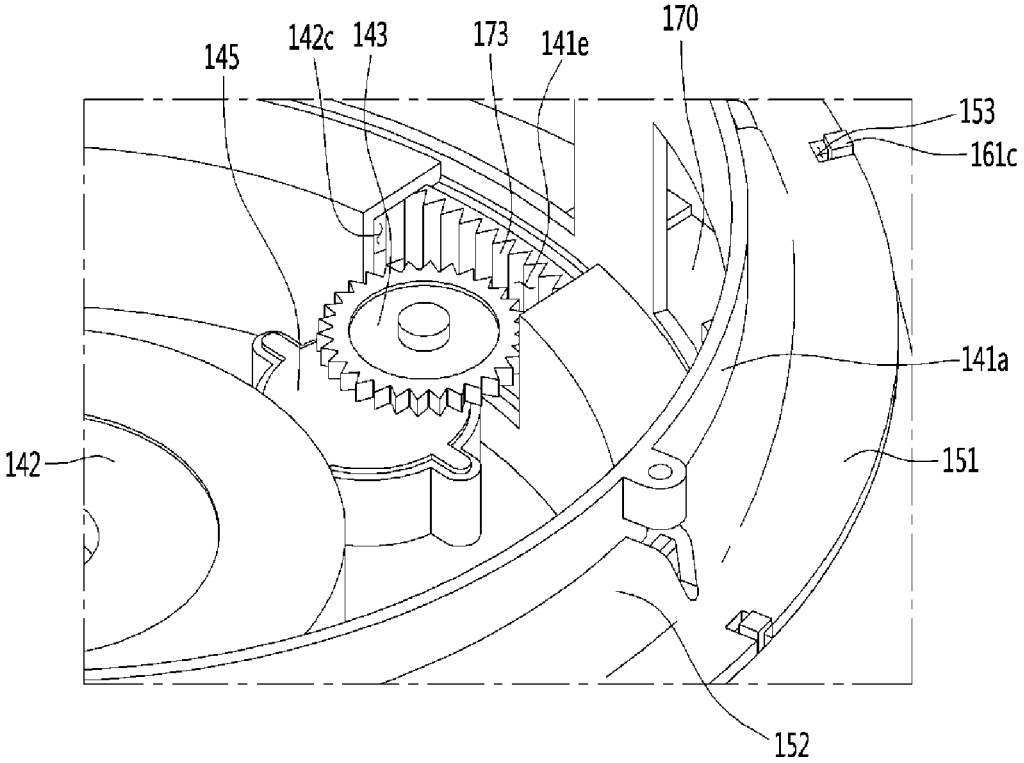
FIG. 11 is a perspective view showing the coupling state of a first pinion gear and a first rack gear of a first blowing device according to an embodiment of the present invention.

FIG. 10 is a top view showing the coupling state of the first pinion gear and the first rack gear of the first blowing device according to the embodiment of the present invention, and FIG. 11 is a perspective view showing the coupling state of the first pinion gear and the first rack gear of the first blowing device according to the embodiment of the present invention.

Referring to FIGS. 10 and 11, the plurality of first pinion gears 143 coupled to the upper fan housing 140 may be exposed to the outside of the upper fan housing 140 by the first recessed parts 141*e* and the second recessed parts 141*c*. In addition, when the first discharge guide device is coupled to the upper fan housing 140, the first rack gear 173 of the configuration of the first discharge guide device may be engaged with the first pinion gear 143.

When the first gear motor 145 coupled to any one of the plurality of first pinion gears 143 is driven to rotate the first pinion gear 143, the first rack gear 173 may be rotated by the first pinion gear 143. According to rotation of the first rack gear 173, the first discharging part 170 may be rotated and the first flow guide part 160 coupled to the first discharging part 170 may also be rotated.

The first flow guide part 160 and the first discharging part 170 may be rotated by 360 degrees in the circumferential direction. Thus, the air introduced through the upper suction part 110 may be discharged in the lateral direction according to the rotation direction of the first flow guide part 160 and the first discharging part 170.

Hereinafter, the second blowing device 200 will be described in detail. The shape of the second blowing device 200 may be equal to the shape of the first blowing device 100 which is turned upside down. That is, if the first blowing device 100 has a truncated cone shape having a diameter gradually decreased from the upper portion to the lower portion thereof, the second blowing device 200 has a truncated cone shape having a diameter gradually decreased from the lower portion to the upper portion thereof.

Figure 12:
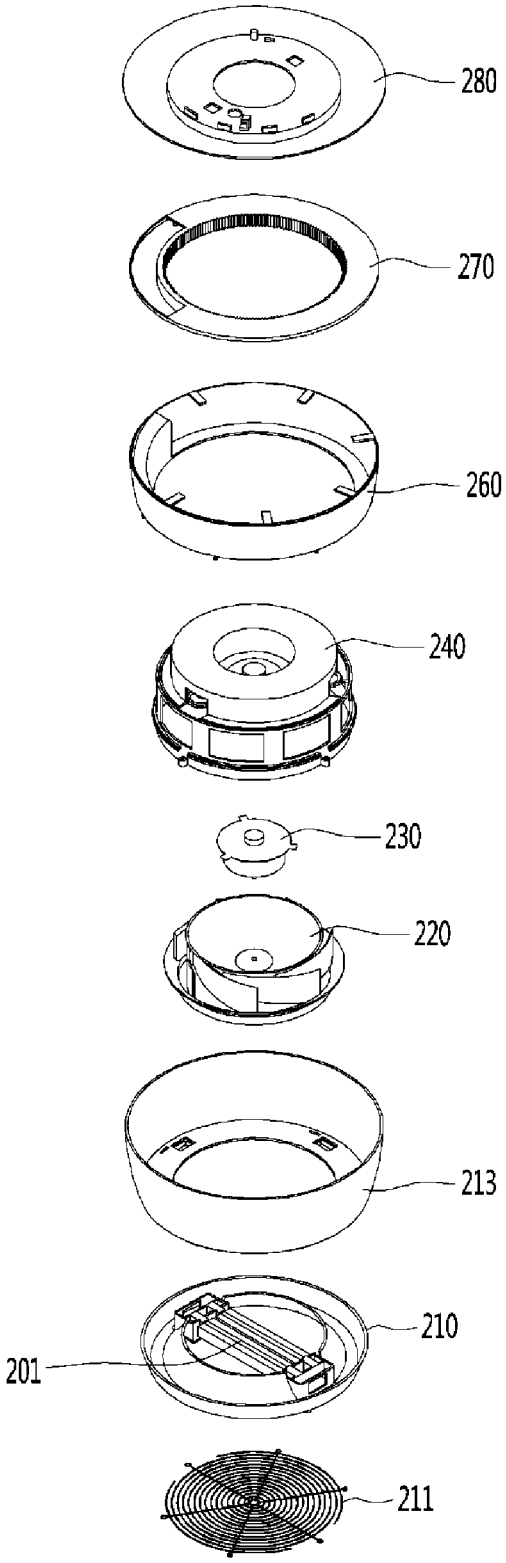
FIG. 12 is an exploded view of a second blowing device according to an embodiment of the present invention.
Figure 13:
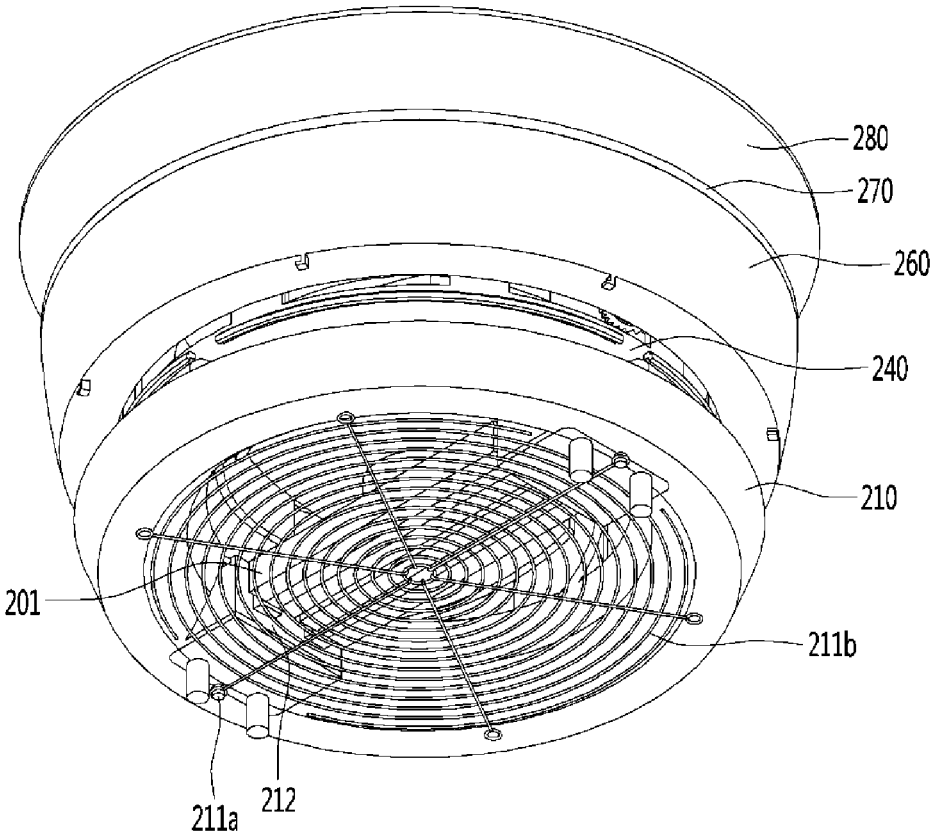
FIG. 13 is a perspective view of a second blowing device according to an embodiment of the present invention, from which a second case is removed.
Figure 14:
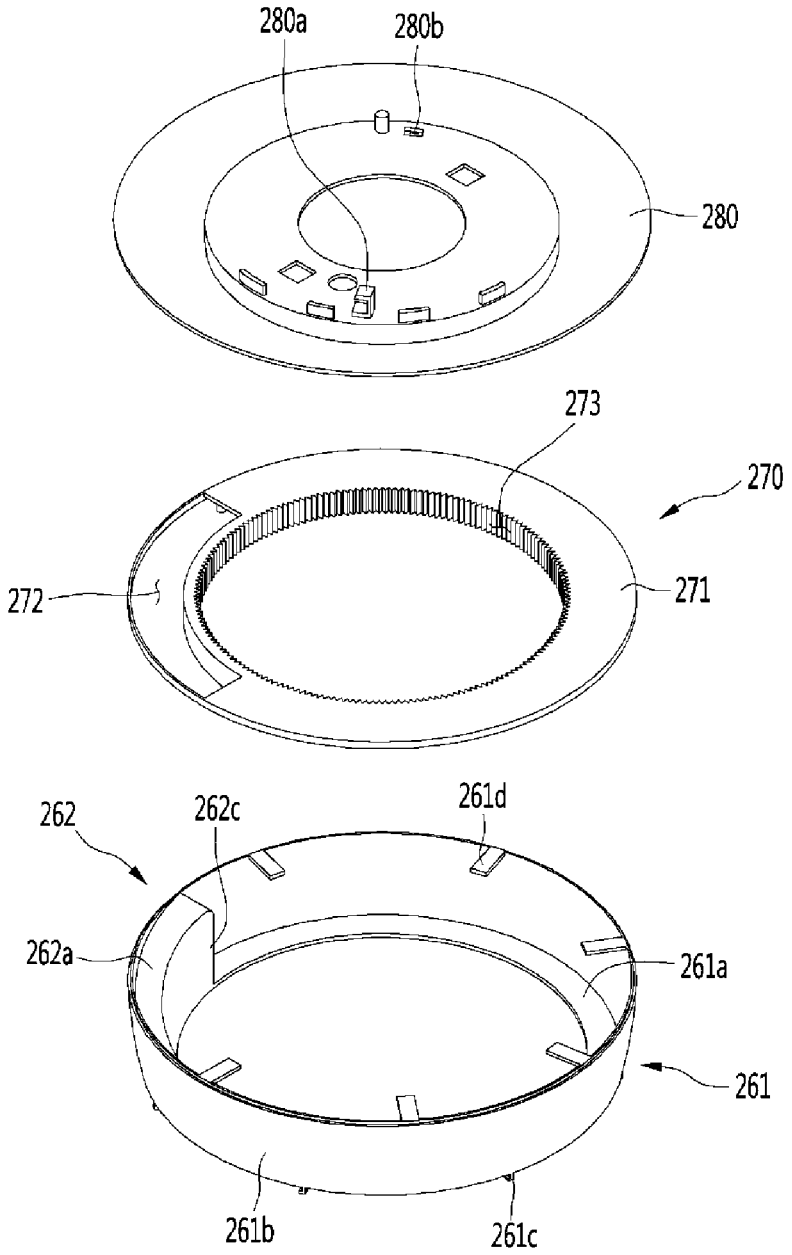
FIG. 14 is an exploded of a second discharge guide device and a second airflow changing device according to an embodiment of the present invention.
Figure 15:
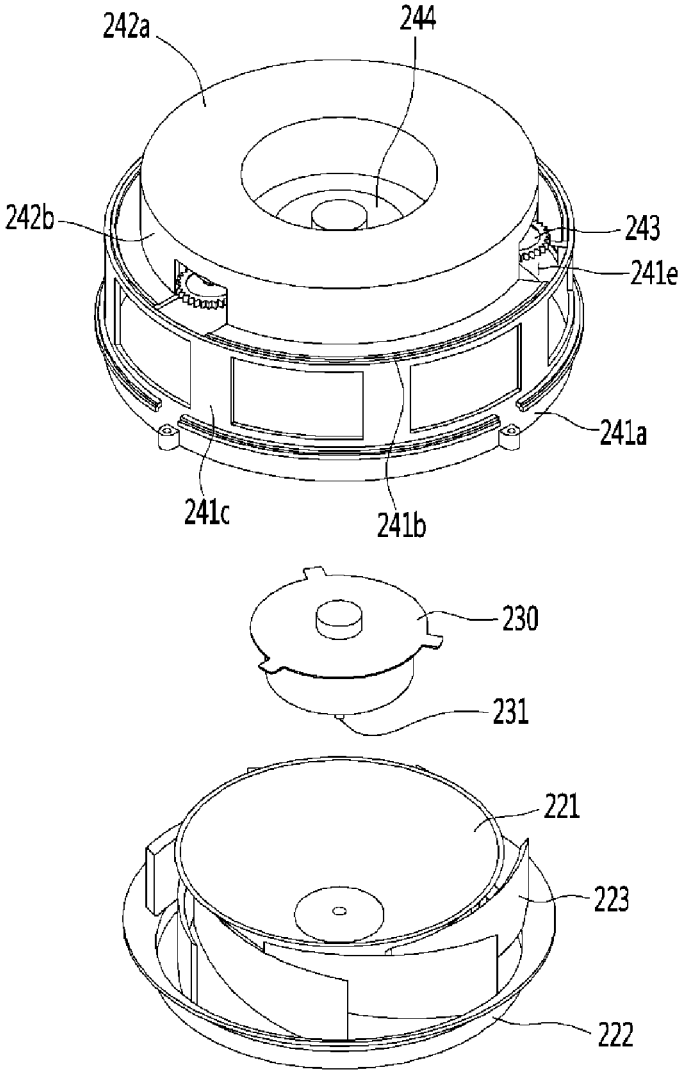
FIG. 15 is an exploded view of a second flow generator according to an embodiment of the present invention.
Figure 16:
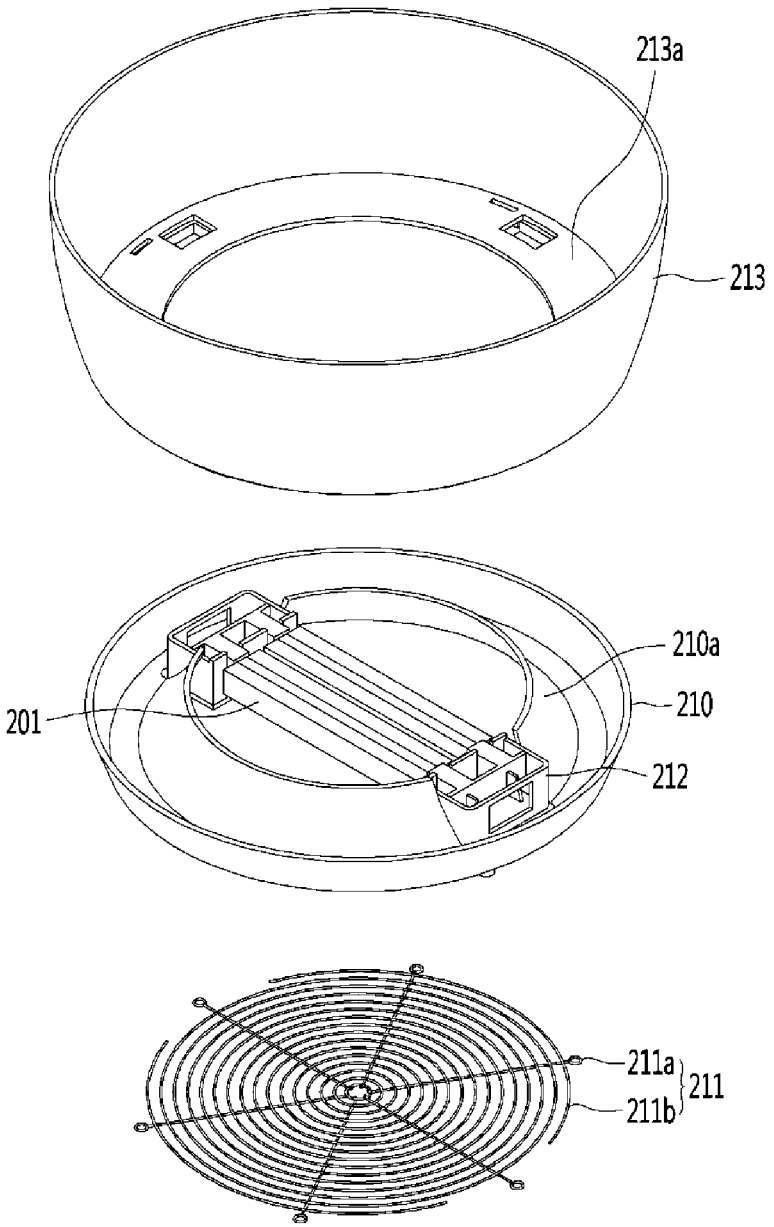
FIG. 16 is an exploded view of a lower suction part and a second case according to an embodiment of the present invention.
Figure 17:
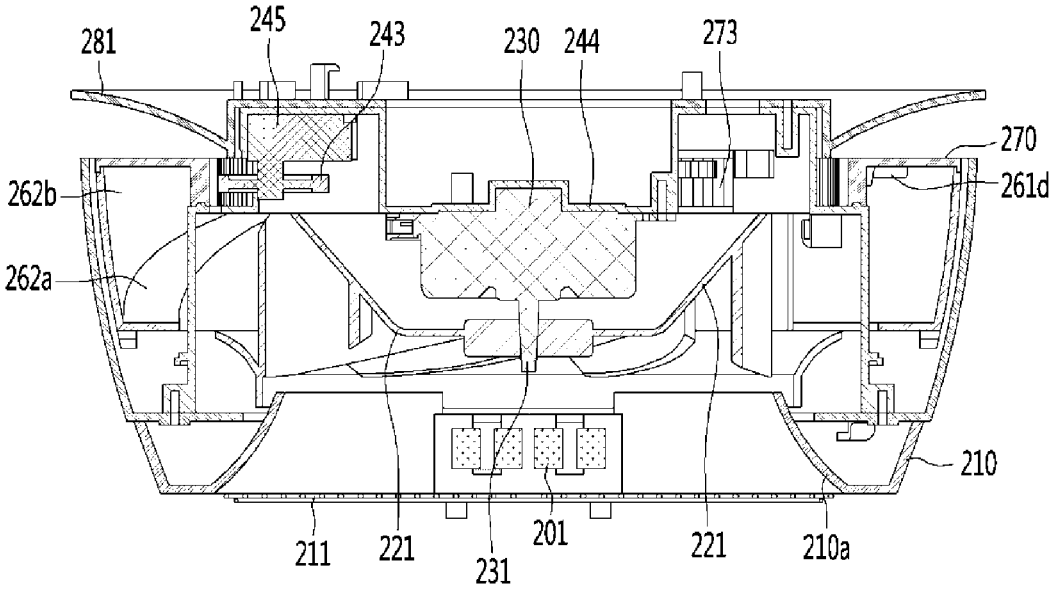
FIG. 17 is a cross-sectional view of a second blowing device according to an embodiment of the present invention.

FIG. 12 is an exploded view of the second blowing device according to the embodiment of the present invention, FIG. 13 is a perspective view of the second blowing device according to the embodiment of the present invention, from which a second case is removed, FIG. 14 is an exploded of a second discharge guide device and a second airflow changing device according to the embodiment of the present invention, FIG. 15 is an exploded view of a second flow generator according to the embodiment of the present invention, FIG. 16 is an exploded view of a lower suction part and a second case according to the embodiment of the present invention, and FIG. 17 is a cross-sectional view of the second blowing device according to the embodiment of the present invention.

Referring to FIGS. 12 to 17, the second blowing device 200 may include a lower suction part 210, a second flow generator, a second flow guide part 260 and a second airflow changing device 280. The second blowing device 200 may suck air located at the lower side of the main body 10 and discharge air at the upper end thereof in a second discharge direction.

The lower suction part 210 may be disposed at the lower portion of the second blowing device 200 to suck indoor air. Specifically, the lower suction part 210 may have a substantially ring shape and include a second suction opening, through which air is sucked. In addition, the lower portion of the lower suction part 210 has a smaller diameter than the upper portion thereof.

The height of the outer circumferential surface of the lower suction part 210 may be greater than that of the inner circumferential surface thereof. That is, a suction extension 210*a* extending from the outer circumferential surface to the inner circumferential surface of the lower suction part 210 may be rounded upward.

A heater 201 may be disposed on the extension surface 210*a* of the lower suction part 210. Specifically, a heater mounting part 212 coupled with the heater 201 may be formed on the extension surface 210*a* of the lower suction part 210.

The heater mounting part 212 may be disposed at one side and the other side of the extension surface 210*a* to support both ends of the heater 201. The heater mounting parts 212 may have a fitting groove, into which both ends of the heater 201 are fitted. This coupling method is merely exemplary and the coupling method is not limited thereto if the heater 201 is coupled to the heater mounting part 212.

The heater 201 has a rod shape and both ends thereof may be fitted into the fitting grooves of the heater mounting part 212. In this case, the heater 201 may be understood as a heating source for selectively heating the air introduced through the lower suction part 210. There is no limitation on the type of the heater.

A grill 211 may be disposed in the second suction opening of the lower suction part 210. The grill 211 may extend from the center thereof in the radial direction. Specifically, the grill 211 may include a plurality of first grills 211*a* coupled to the lower surface of the lower suction part 210 and a plurality of second grills 211*b* connected to the first grills 211*a* in a circular shape.

The grill 211 is formed of a metal material and thus is heated along with the heater 201, such that the air introduced through the lower suction part 210 is entirely and uniformly heated.

As the heater and the grill 211 are disposed in the lower suction part 210, the user can discharge cool air by not driving the heater in the hot weather such as in summer and can discharge warm air by driving the heater in the cold weather such as in winter.

The second case 213 may be connected to the upper portion of the lower suction part 210 to form the appearance of the second blowing device 200. For example, the second case 213 may have a substantially ring shape, and the diameter of the lower portion of the second case 213 may be substantially equal to that of the upper portion of the lower suction part 210, and the upper portion of the second case 213 may have a larger diameter than the lower portion thereof.

The second case 213 may have the same shape as the first case 113 which is turned upside down. The extension from the upper portion to the lower portion of the second case 213 may be rounded to have a predetermined curvature.

A second flow generator may be disposed on the inner circumferential surface side of the second case 213. Specifically, the second flow generator may be understood as a means for generating flow of air sucked into the lower suction part 210 and the airflow B discharged to the second discharge guide device.

The second flow generator will be described in detail.

The second flow generator may have the same shape as the first flow generator which is turned upside down. Specifically, the second flow generator may include a lower fan 220 that is rotated, a lower fan motor 230 for transmitting rotational force to the lower fan 220, and a lower fan housing 240 in which the lower fan 220 and the lower fan motor 230 are received.

The lower fan motor 230 includes a rotation shaft coupled to the lower fan housing 240 and transmit drive force to the lower fan 220. The configuration of second fan motor 230 is similar to the configuration of the upper fan motor 130 and thus a detailed description thereof will be omitted.

The lower fan 220 may be a means which is coupled to the lower fan motor 230 to be rotated. For example, the lower fan 220 may include a centrifugal fan for introducing air in the axial direction and discharging air in the upward radial direction.

Specifically, the lower fan 220 may include a hub 221 coupled with the rotation shaft of the second fan 230, a shroud 222 spaced apart from the hub 221 and a plurality of blades 223 disposed between the hub 221 and the shroud 222. The configuration of the lower fan 220 is similar to the configuration of the upper fan 120 and thus a detailed description will be omitted.

The air passing through the heater from below through the lower suction part 210 flows upward and flows in the axial direction of the lower fan 220, thereby flowing in the upward radial direction through the blades 223.

The lower fan housing 240 may include a second coupling fan housing 242, in which the lower fan 220 and the lower fan motor 230 are received, and a second side fan housing 241 disposed below the lower fan housing 240.

The second coupling fan housing 242 has the same shape as the structure obtained by turning the first coupling fan housing 142 upside down, and the second side fan housing 241 may have the same shape as the structure obtained by turning the first side fan housing 141 upside down. A reception space, in which the lower fan 220 and the lower fan motor 230 are received, is formed in the second coupling fan housing 242 and the second side fan housing 241.

The second coupling fan housing 242 may include a second upper surface part 242*a*, a second side surface part and a lower fan motor coupling part 244, which have the same shape as the structure obtained by turning the second lower surface part 142*a*, the second side surface part 142*b* and the upper fan motor coupling part 144 of the first coupling fan housing 142 upside down. Therefore, a repeated description thereof will be omitted.

The second side fan housing 241 may include a third upper surface part 241*b*, a third lower surface part 241*a* and a second extension 241*c*, which have the same shape as the structure obtained by turning the first lower surface part 141*b*, the first upper surface part 141*a* and the first extension 141*c* of the first side fan housing 141 upside down. Therefore, a repeated description thereof will be omitted.

For convenience of description, the second pinion gear 243 is disposed at the position of the lower fan housing 240 corresponding to the position of the upper fan housing 140 where the first pinion gear 143 is disposed. In addition, a second drive motor 245 for driving the second pinion gear 243 may be connected to the second pinion gear 243.

The second blowing device 200 may further include a second discharge guide device disposed between the second flow generator and the second case 213 to rotate in order to guide and discharge flow of air generated by the second flow generator to the outside.

The second discharge guide device may include a second flow guide part 260 for guiding flow of air generated by the second flow generator and a second discharging part 270 disposed above the second flow guide part 260 to discharge the guided air to the outside. The second discharge guide device may be rotated in the circumferential direction.

The second flow guide part 260 and the second discharging part 270 may have the same shape as the first flow guide part 160 and the first discharging part 170 which are turned upside down.

Specifically, the second flow guide part 260 may include a third airflow guide part 261 and a fourth airflow guide part 262. The third airflow guide part 261 and the fourth airflow guide part 262 have the same configuration as the first airflow guide part 161 and the second airflow guide part 162 and thus a repeated description thereof will be omitted.

The second discharging part 270 may include a second discharging part main body 271 having a second discharging port 272 formed therein and a second rack gear 273, which have the same configurations as the first discharging part main body 172 having the first discharging port 172 formed therein and the first rack gear 173 of the first discharging part 170. Therefore, a repeated description thereof will be omitted. That is, the second discharging port 272 may be formed in the second discharging main body 271 to have the same length as the extension length of the fourth airflow guide part 262.

The second discharge guide device may not include the configuration of the guide support device 150 of the first discharge guide device. The diameter of the first blowing device 100 is gradually increased from the upper portion to the lower portion thereof, whereas the diameter of the second blowing device 200 is gradually decreased from the upper portion to the lower portion thereof. Therefore, since the second flow guide part 260 may not be detached downward and thus the second flow guide part 260 may not be supported.

The second blowing device 200 may further include a second airflow changing device 280 disposed above the second discharge guide device to change flow of air discharged from the second discharge guide device in the lateral direction.

The second airflow changing device 280 has a ring shape and may include an inclined surface inclined upwardly to the outside at the lower surface thereof. The flow direction of the air discharged upwardly from the second discharge guide device may be changed to the lateral direction by the inclined surface of the second airflow changing device 280.

The lower surface of the first airflow changing device 180 and the upper surface of the second airflow changing device 280 may be coupled to each other. Specifically, the upper surface of the first airflow changing device 180 and the lower surface of the second airflow changing device 280 may be coupled by fitting a rib into a groove.

By coupling between the first airflow changing device 180 and the second airflow changing device 280, the first blowing device 100 and the second blowing device 200 may configure a main body as one device. The first airflow changing device 180 and the second airflow changing device 280 may be collectively referred to as an "airflow changing device".

The first airflow A discharged from the first discharge guide device and the second airflow B discharged from the second discharge guide device are combined by the airflow changing devices 180 and 280 to form the third airflow C. Specifically, when the first discharging port 172 and the second discharging port 272 are vertically aligned, the discharge directions of the first airflow A discharged from the first discharging port 172 and the second airflow B discharged from the second discharging port 272 may become equal by the airflow changing devices 180 and 280. In this case, the third airflow C may be formed.

Hereinafter, the rotation configuration of the second discharge guide device will be described.

Figure 18:
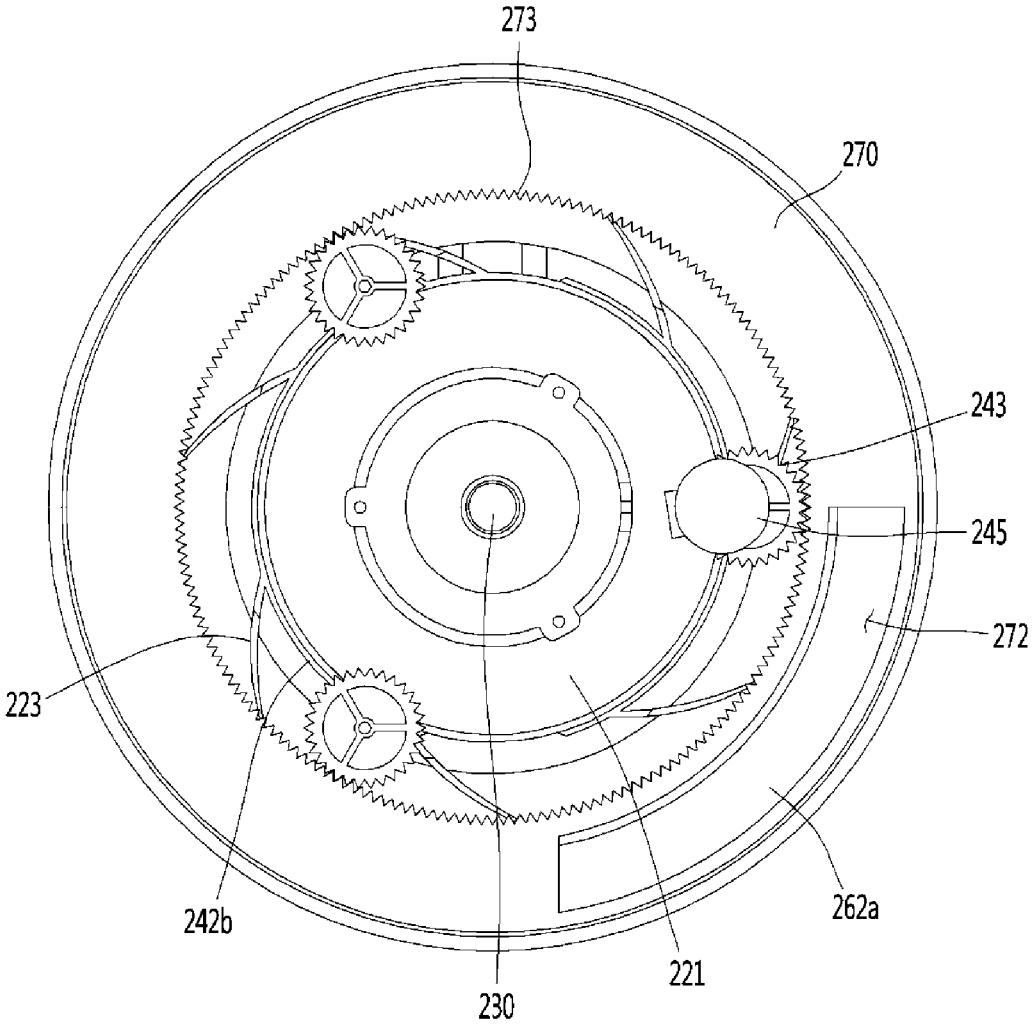
FIG. 18 is a top view showing the coupling state of a second pinion gear and a second rack gear of a second blowing device according to an embodiment of the present invention.
Figure 19:
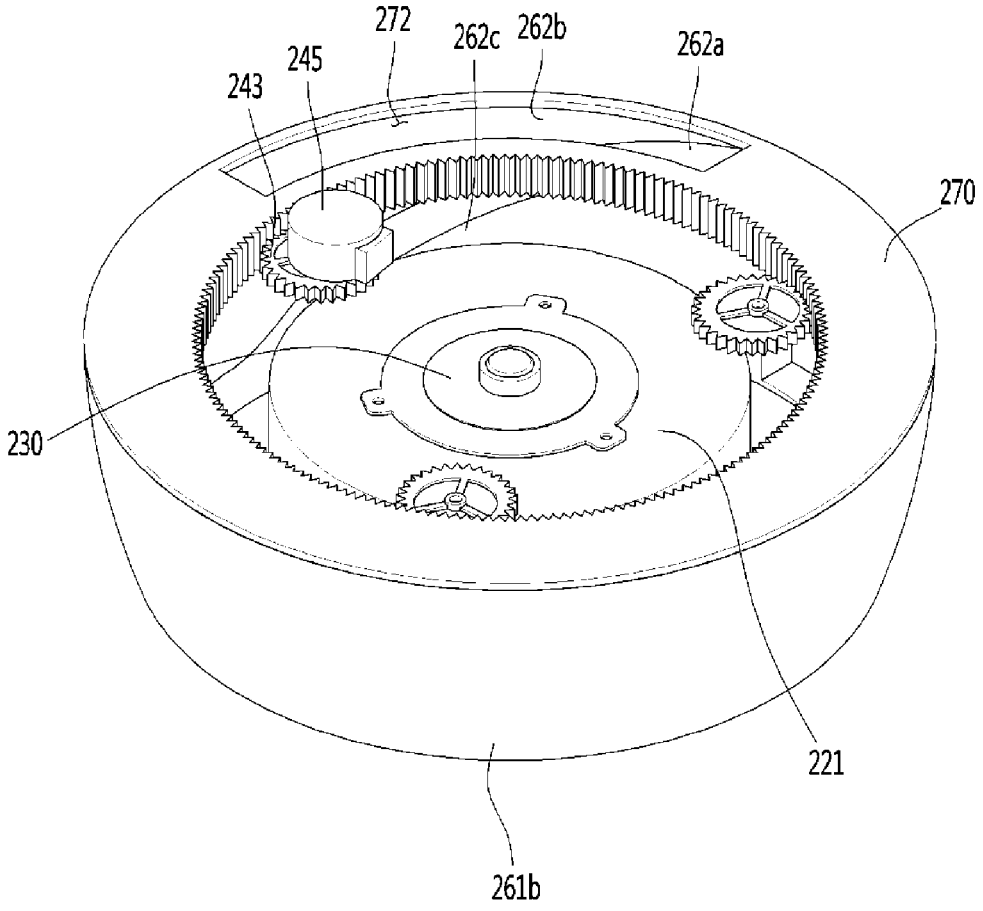
FIG. 19 is a perspective view showing the coupling state of a second pinion gear and a second rack gear of a second blowing device according to an embodiment of the present invention.

FIG. 18 is a top view showing the coupling state of the second pinion gear and the second rack gear of the second blowing device according to the embodiment of the present invention, and FIG. 19 is a perspective view showing the coupling state of the second pinion gear and the second rack gear of the second blowing device according to the embodiment of the present invention.

Referring to FIGS. 18 and 19, some of the plurality of second pinion gears 243 coupled to the lower fan housing 240 may be exposed to the outside of the lower fan housing 240. When the second discharge guide device is coupled to the lower fan housing 240, the second rack gear 273 may be engaged with the second pinion gear 243.

When the first gear motor 145 coupled to any one of the plurality of second pinion gears 243 is driven to rotate the second pinion gear 243, the second rack gear 273 may be rotated by the second pinion gear 243. According to rotation of the second rack gear 273, the second discharging part 270 may be rotated and the second flow guide part 260 coupled to the second discharging part 270 may also be rotated.

The second flow guide part 260 and the second discharging part 270 may be rotated by 360 degrees in the circumferential direction. Therefore, the air introduced through the lower suction part 210 may be discharged in the lateral direction according to the rotation direction of the second flow guide part 260 and the second discharging part 270.

Figure 20:
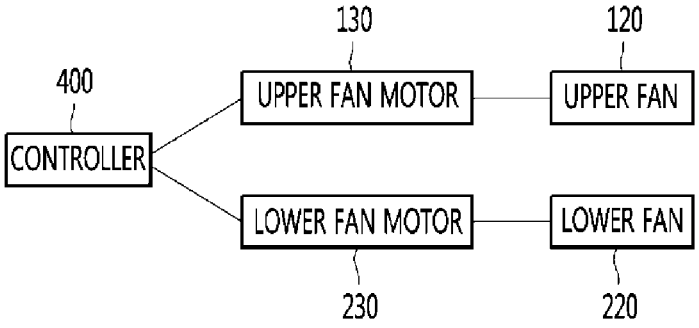
FIG. 20 is a block diagram showing connection of a controller of a blower according to an embodiment of the present invention.

Hereinafter, the configuration for controlling the vertical direction of air discharged by the blower according to the embodiment of the present invention will be described in detail. FIG. 20 is a block diagram showing connection of a controller of a blower according to an embodiment of the present invention.

Referring to FIG. 20, the blower according to the embodiment of the present invention may further include a controller 400. Specifically, the controller 400 may be received in the support device 300.

The controller 400 may control the rotation speeds of the upper fan 120 and the lower fan 220. Specifically, the controller 400 may be electrically connected to the upper fan motor 130 and the lower fan motor 230 so as to control the revolutions per minute (RPM) of the upper fan motor 130 connected to the upper fan 120 and the RPM of the lower fan motor 230 connected to the lower fan 220.

The controller 400 may control the revolutions per minute of the upper fan motor 130 and the revolutions per minute of the lower fan motor 230, thereby adjusting the vertical direction of the third airflow C discharged from the main body 10.

FIG. 21 is a view showing an airflow generated in a blower according to an embodiment of the present invention.

Referring to FIG. 21, in the main body 10 of the blowing device according to the embodiment of the present invention, a first airflow A, a second airflow B and a discharge airflow C may be generated.

The first airflow may be flow of air introduced from the upper side of the main body through the first suction part 110 disposed at the upper side of the first blowing device 100 and discharged through the first discharging part 170.

Specifically, when the upper fan 120 rotates, air is introduced into the upper end of the first suction part 110, the introduced air flows outward and downward by the upper fan 120 and then flows into the lower end of the first blowing device 100 through the first flow guide part 160 and the first discharging part 170. Such an airflow forms the first airflow A.

The second airflow B may be flow of air introduced from the lower side of the main body 10 through the lower suction part 210 disposed at the lower side of the second blowing device 200.

Specifically, when the lower fan 220 rotates, air is introduced into the lower end of the second suction part 210 and the introduced air flows outward upward by the lower fan 220 and then flows into the upper end of the second blowing device 200 through the second flow guide part 260 and the second discharging part 270. Such an airflow forms the second airflow B.

The first airflow A and the second airflow B may flow to become close to each other, that is, toward the center of the main body 100 in the vertical direction.

If the first airflow A and the second airflow B are discharged to the outside of the main body, that is, the outside of the airflow changing device, the first airflow A and the second airflow B may be combined and discharged.

If the first airflow A and the second airflow B are discharged to the outside of the main body, the first airflow A and the second airflow B are combined to form the discharge airflow C. Specifically, the first airflow A flowing into the lower end of the first blowing device 100 and the second airflow B flowing into the upper end of the second blowing device 200 may be combined while being changed by the airflow changing devices 180 and 280, thereby being discharged to the outside of the main body 10.

By a difference in air volume between the first airflow A and the second airflow B, the discharge direction of the discharge airflow C may be determined. For example, if the air volume of the first airflow A is greater than that of the second airflow B, the discharge direction of the discharge airflow C may be an outward and downward direction. In contrast, if the air volume of the second airflow C is greater than that of the first airflow A, the discharge direction of the discharge airflow C may be an outward and upward direction.

The vertical control operation of the airflows A and B may be performed only when the discharge directions of the first airflow A introduced into and discharged from the first blowing device 100 and the second airflow B introduced into and discharged from the second blowing device 200 are the same.

Accordingly, hereinafter, the case where the first discharging port 172 of the first discharging part 170 and the second discharging port 272 of the second discharging part 270 are vertically aligned and the first airflow A discharged through the first discharging part 170 and the second airflow B discharged through the second discharging part 270 are combined by the airflow changing devices 180 and 280 and discharged to the outside of the main body 10 will be described.

Hereinafter, upward operation of discharging the third airflow upward will be described.

Figure 22:
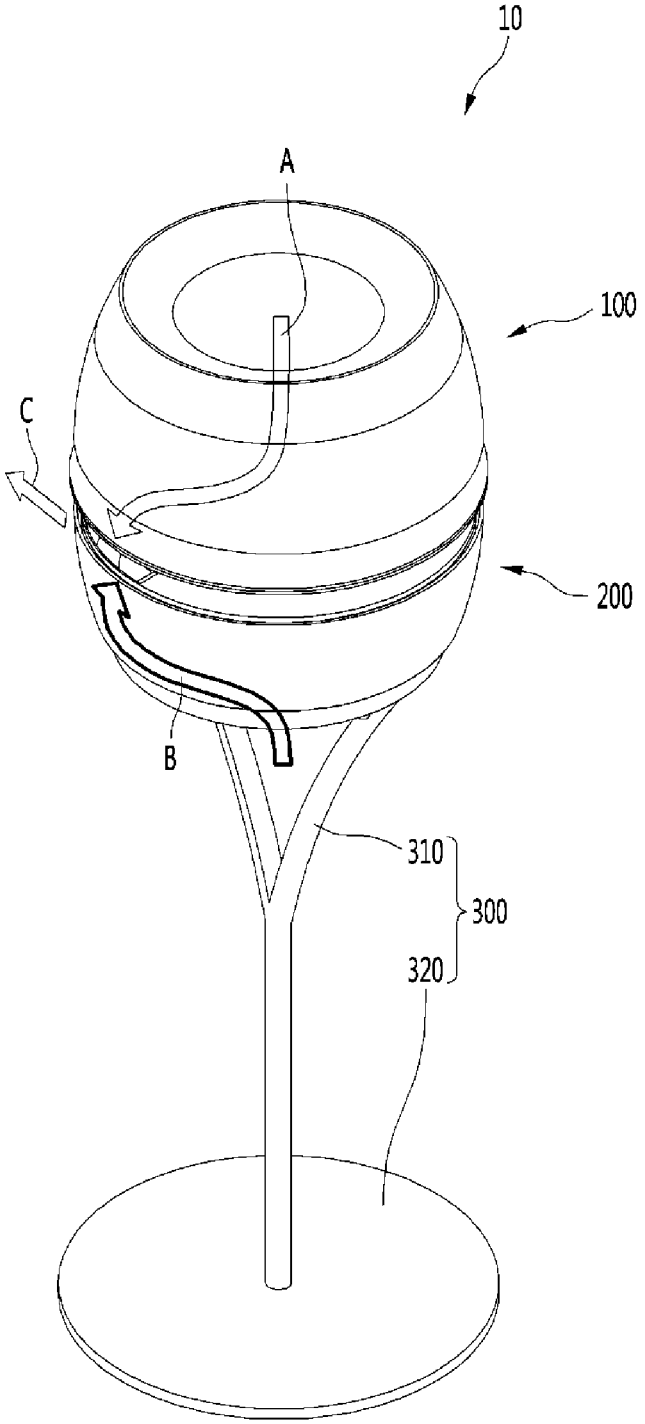
FIG. 22 is a view showing upward operation of a blower according to an embodiment of the present invention.

FIG. 22 is a view showing upward operation of a blower according to an embodiment of the present invention.

Referring to FIG. 22, in the upward operation of the blower, in order to discharge the third airflow C to the upper side of the airflow changing devices, the controller 400 may control the rotation speed of the lower fan 220 to be greater than that of the upper fan 120. Specifically, the controller 400 may control the revolutions per minute of the lower fan motor 230 to be greater than that of the upper fan motor 130, such that the third airflow C is discharged to the upper side of the airflow changing devices 180 and 280.

In this case, since the intensity of the second airflow B generated by the lower fan 220 is greater than that of the first airflow A generated by the upper fan 120, the second airflow B discharged through the airflow changing devices 180 and 280 pushes the first airflow A upward. Accordingly, the third airflow C generated by combining the first and second airflows A and B is discharged to the upper side of the airflow changing devices.

For example, the controller 400 may control a ratio of the revolutions per minute of the upper fan motor 130 to the revolutions per minute of the lower fan motor 230 to 1:2, thereby discharging the third airflow C to the upper side of the airflow changing devices. Specifically, the controller 400 may control the revolutions per minute of the upper fan motor 130 to 1000 rpm and control the revolutions per minute of the lower fan motor 230 to 500 rpm and operate the main body 10. However, the ratio of the revolutions per minute of the upper fan motor 130 to the revolutions per minute of the lower fan motor 230 is merely exemplary, and the revolutions per minute and the ratio thereof may be changed according to the type of the motor and the size of the fan.

Hereinafter, downward operation of discharging the third airflow upward will be described.

Figure 23:
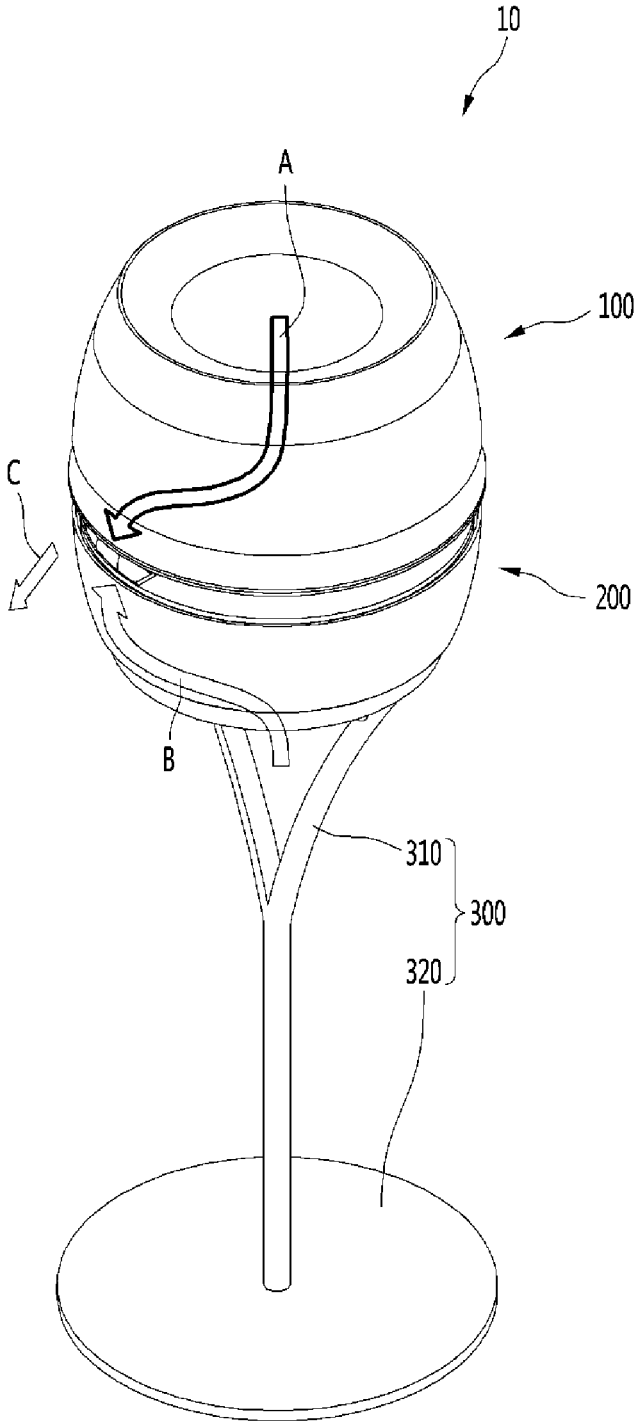
FIG. 23 is a view showing downward operation of a blower according to an embodiment of the present invention.

FIG. 23 is a view showing downward operation of a blower according to an embodiment of the present invention.

Referring to FIG. 23, in the downward operation of the blower, in order to discharge the third airflow C to the lower side of the airflow changing devices, the controller 400 may control the rotation speed of the upper fan 120 to be greater than that of the lower fan 220. Specifically, the controller 400 may control the revolutions per minute of the upper fan motor 130 to be greater than that of the lower fan motor 230, such that the third airflow C is discharged to the lower side of the airflow changing devices.

In this case, since the intensity of the first airflow A generated by the upper fan 120 is greater than that of the second airflow B generated by the lower fan 220, the first airflow A discharged through the airflow changing devices 180 and 280 pushes the second airflow B downward. Accordingly, the third airflow C generated by combining the first and second airflows A and B is discharged to the lower side of the airflow changing devices 180 and 280.

For example, the controller 400 may control a ratio of the revolutions per minute of the upper fan motor 130 to the revolutions per minute of the lower fan motor 230 to 2:1, thereby discharging the third airflow C to the lower side of the airflow changing devices. Specifically, the controller 400 may control the revolutions per minute of the upper fan motor to 500 rpm and control the revolutions per minute of the lower fan motor 230 to 1000 rpm and operate the main body 10. However, the ratio of the revolutions per minute of the upper fan motor 130 to the revolutions per minute of the lower fan motor 230 is merely exemplary, and the revolutions per minute and the ratio thereof may be changed according to the type of the motor and the size of the fan.

Hereinafter, reciprocating operation of the blower according to the embodiment of the present invention will be described.

Figure 24:
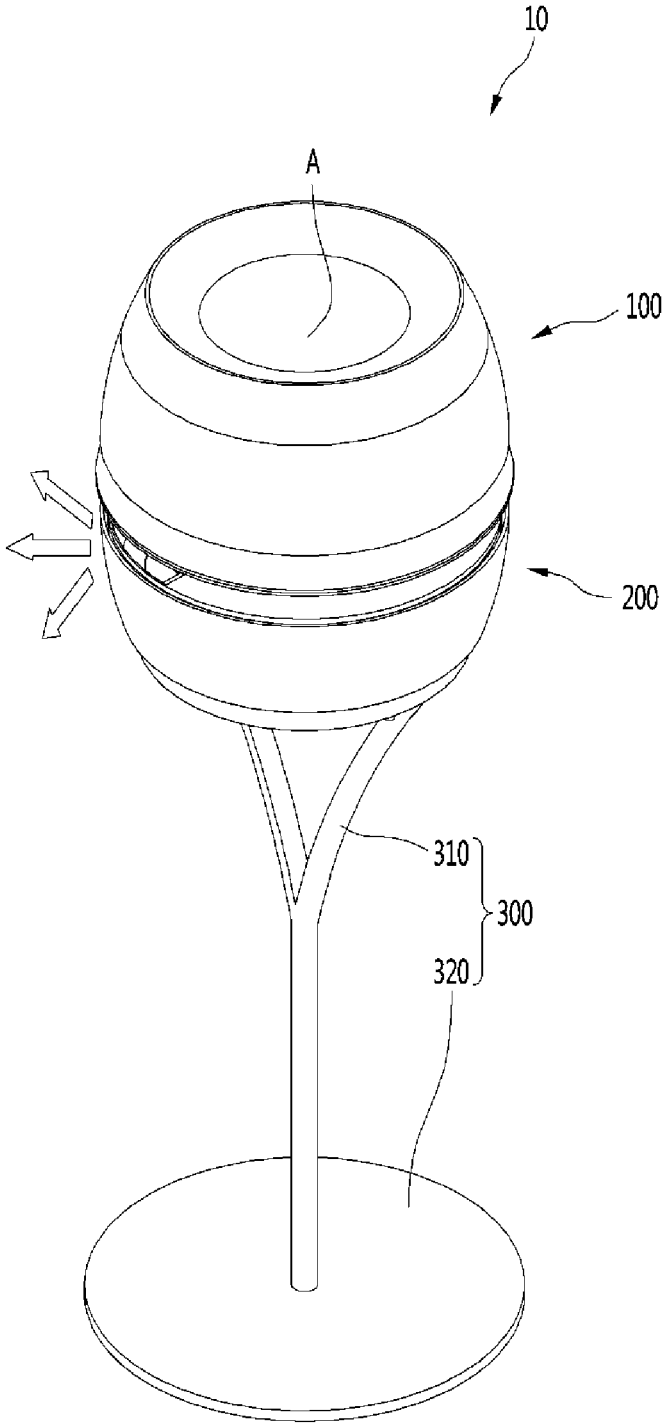
FIG. 24 is a view showing reciprocating operation of a blower according to an embodiment of the present invention.

FIG. 24 is a view showing reciprocating operation of a blower according to an embodiment of the present invention.

Referring to FIG. 24, the controller 400 may change the revolutions per minute of the upper fan motor 130 and the revolutions per minute of the lower fan motor 230, thereby changing the vertical direction of the third airflow C discharged from the main body 10 with time.

Specifically, the controller 400 may change the revolutions per minute of the upper fan motor 130 in a first set range and change the revolutions per minute of the lower fan motor 230 in a second set range. More specifically, the controller may gradually increase the revolutions per minute of the upper fan motor 130 from a minimum value to a maximum value of the first set range or gradually decrease the revolutions per minute of the upper fan motor 130 from a maximum value to a minimum value of the first set range.

Similarly, the controller 400 may gradually increase the revolutions per minute of the lower fan motor 230 from a minimum value to a maximum value of the second set range or gradually decrease the revolutions per minute of the lower fan motor 230 from a maximum value to a minimum value of the second set range.

In addition, the controller 400 may alternately repeat increase and decrease in the revolutions per minute of the upper fan motor 130 and the revolutions per minute of the lower fan motor 230, thereby performing reciprocating operation.

Specifically, the controller 400 may perform control to discharge the third airflow C discharged from the main body while reciprocating in the upper and lower direction of the airflow changing devices 180 and 280, through reciprocating operation of increasing or decreasing the revolutions per minute of the upper fan motor 130 and the revolutions per minute of the lower fan motor 230 in inverse proportion to each other.

That is, in the reciprocating operation state, the third airflow C discharged from the main body 10 may be discharged while reciprocating between the upper and lower sides of the airflow changing devices. Therefore, the air conditioning effect of a space where the blower is installed is increased and a plurality of users can feel comfortable by the third airflow C.

As the reciprocating operation, first reciprocating operation and second reciprocating operation may be alternately performed.

Figure 25:
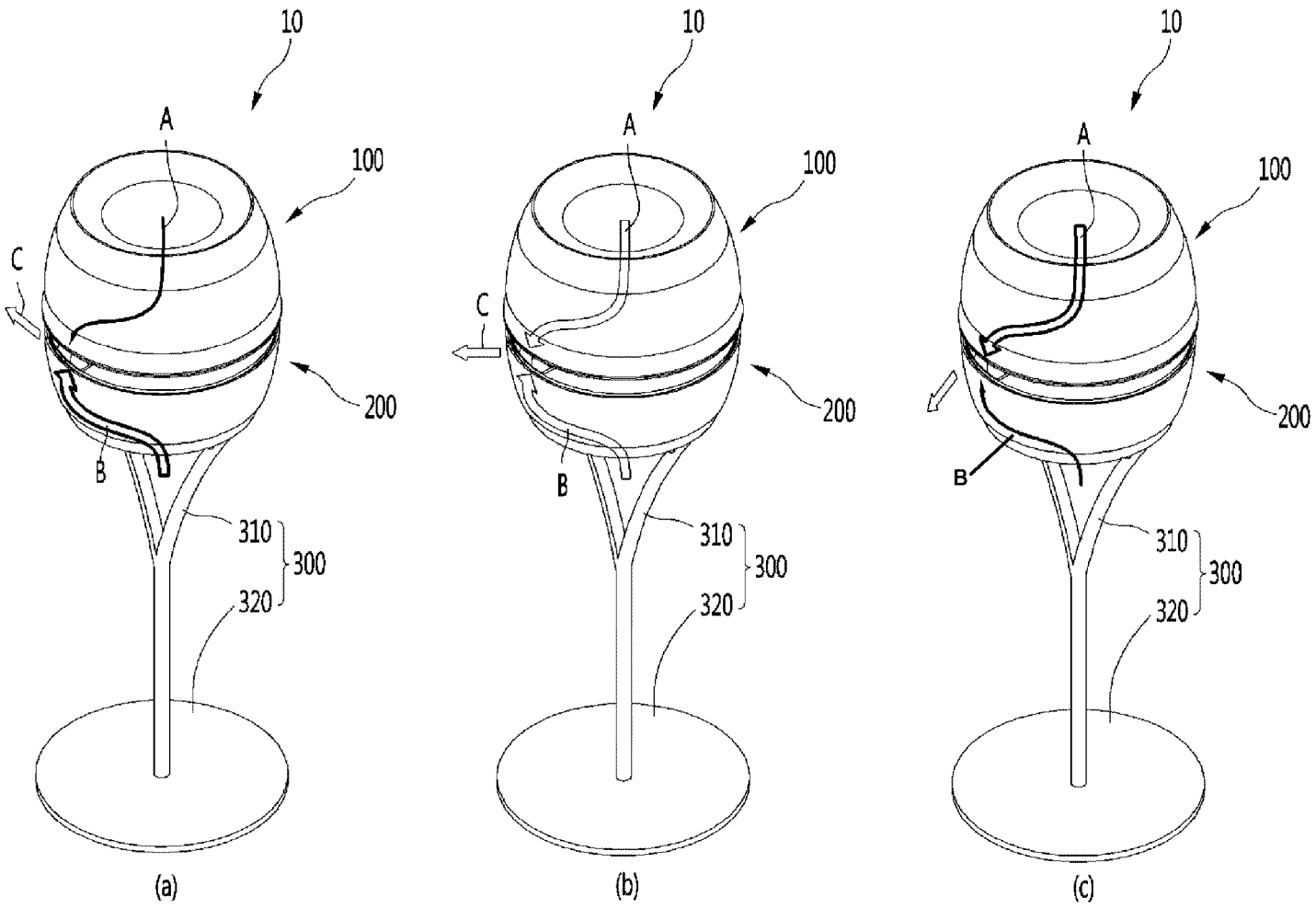
FIG. 25 is a view showing first reciprocating operation of a blower according to an embodiment of the present invention.
Figure 26:
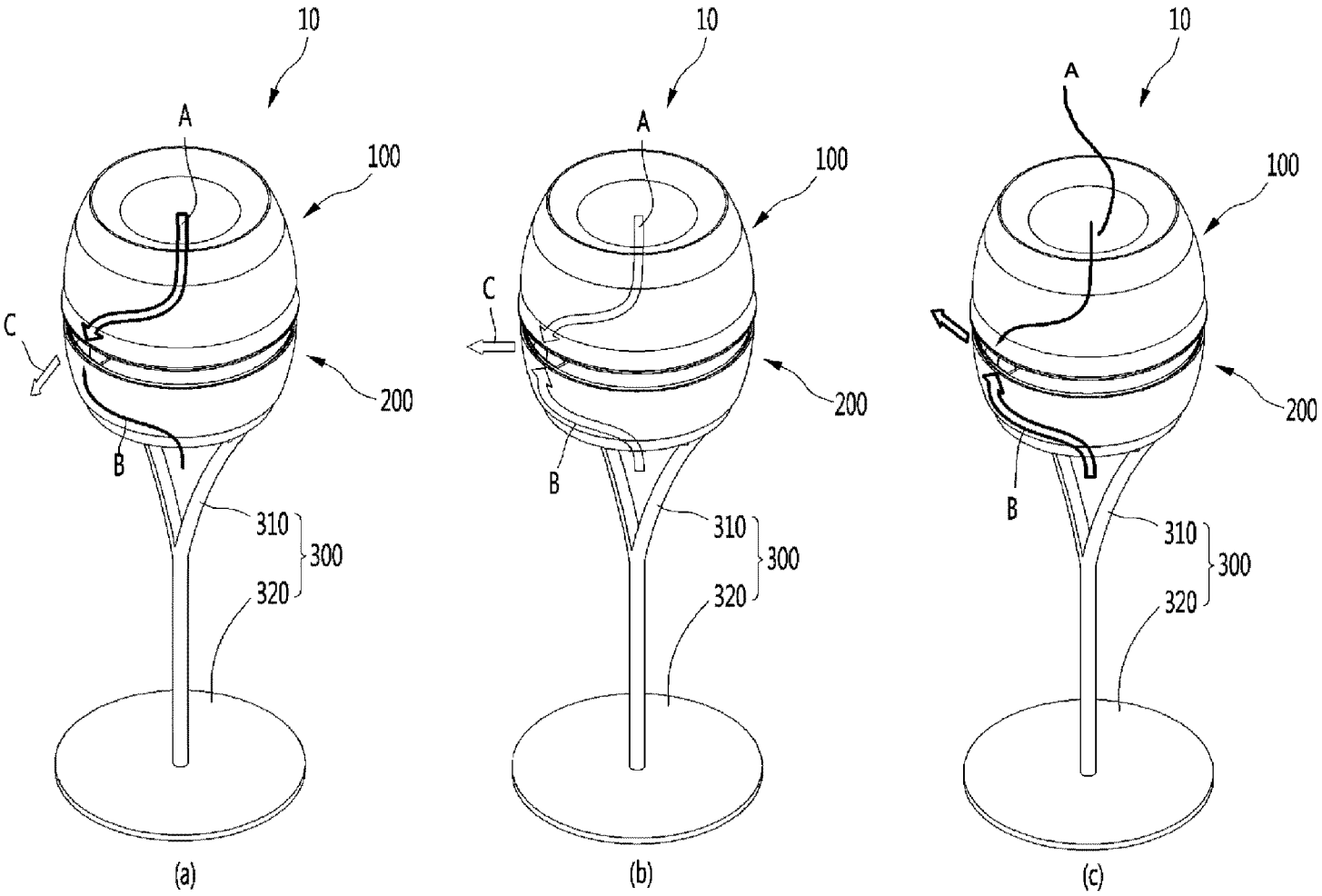
FIG. 26 is a view showing second reciprocating operation of a blower according to an embodiment of the present invention.

FIG. 25 is a view showing first reciprocating operation of a blower according to an embodiment of the present invention, and FIG. 26 is a view showing second reciprocating operation of a blower according to an embodiment of the present invention.

Referring to FIG. 25, the controller 400 may gradually increase the revolutions per minute of the upper fan motor 130 from the minimum value to the maximum value of the first set range and, at the same time, gradually decrease the revolutions per minute of the lower fan motor 230 from the maximum value to the minimum value of the second set range, thereby performing the first reciprocating operation of the blower. In the first reciprocating operation state, the direction of the third airflow C may be changed from the upper side to the lower side of the airflow changing devices 180 and 280 at a constant speed.

Hereinafter, assume that the first set range is from 500 to 1000 rpm and the second set range is from 500 to 1000 rpm.

For example, referring to (a) of FIG. 25, the controller 400 may control the revolutions per minute of the upper fan motor 130 to 500 rpm which is the minimum value of the first set range and control the revolutions per minute of the lower fan motor 230 to 1000 rpm which is the maximum value of the second set range. In this case, since the intensity of the second airflow B is greater than the intensity of the first airflow A, the direction of the third airflow C discharged from the main body 10 may be the upper side of the airflow changing devices 180 and 280.

In this state, the controller 400 may increase the revolutions per minute of the upper fan motor 130 to 1000 rpm which is the maximum value of the first set range and decrease the revolutions per minute of the lower fan motor 230 to 500 rpm which is the minimum value of the second set range at a constant speed, thereby performing the first reciprocating operation of the blower.

Specifically, in order for the main body 10 to switch from the state of (a) to the state of (b) of FIG. 25, the controller 400 may perform control the intensities of the first airflow A and the second airflow B to become same by increasing the revolutions per minute of the upper fan motor 130 to 750 rpm and decreasing the revolutions per minute of the lower fan motor 230 to 750 rpm, thereby discharging the third airflow C in the outward horizontal direction of the airflow changing devices 180 and 280.

In addition, in order for the main body 10 to switch from the state of (b) to the state of (c) of FIG. 25, the controller 400 may perform control the intensity of the first airflow A to become greater than that of the second airflow B by increasing the revolutions per minute of the upper fan motor 130 to 1000 rpm and decreasing the revolutions per minute of the lower fan motor 230 to 500 rpm, thereby discharging the third airflow C to the lower side of the airflow changing devices 180 and 280.

That is, the controller 400 may control the revolutions per minute of the upper fan motor 130 and the revolutions per minute of the lower fan motor 230 such that the direction of the third airflow C is changed from the upper side to the lower side of the airflow changing devices of the main body 10 in order of (a), (b) and (c) of FIG. 25.

Referring to FIG. 26, when the revolutions per minute of the upper fan motor 130 reaches the maximum value of the first set range and the revolutions per minute of the lower fan motor 230 reaches the minimum value of the second set range, the controller 400 may gradually decrease the revolutions per minute of the upper fan motor 130 to the maximum value to the minimum value of the first set range and gradually increase the revolutions per minute of the lower fan motor 230 from the minimum value to the maximum value of the second set range, thereby performing the second reciprocating operation of the blower.

In the second reciprocating operation state, the direction of the third airflow C may be changed from the lower side to the upper side of the airflow changing device at a predetermined speed.

For example, referring to (a) of FIG. 26, the controller 400 may control the revolutions per minute of the upper fan motor 130 to 1000 rpm which is the maximum value of the first set range and control the revolutions per minute of the lower fan motor 230 to 500 rpm which is the minimum value of the second set range. In this case, the direction of the third airflow C discharged from the main body 10 may be the lower side of the airflow changing devices 180 and 280.

In this state, the controller 400 may decrease the revolutions per minute of the upper fan motor 130 to 500 rpm which is the minimum value of the first set range and increase the revolutions per minute of the lower fan motor 230 to 1000 rpm which is the maximum value of the second set range at a constant speed, thereby performing the second reciprocating operation of the blower.

Specifically, in order for the main body 10 to switch from the state of (a) to the state of (b) of FIG. 26, the controller 400 may decrease the revolutions per minute of the upper fan motor 130 to 750 rpm and increase the revolutions per minute of the lower fan motor 230 to 750 rpm, thereby changing the discharge direction of the third airflow C from the lower side to the outward horizontal direction of the airflow changing devices 180 and 280.

In addition, in order for the main body 10 to switch from the state of (b) to the state of (c) of FIG. 26, the controller 400 may decrease the revolutions per minute of the upper fan motor 130 to 500 rpm and increase the revolutions per minute of the lower fan motor 230 to 1000 rpm, thereby changing the discharge direction of the third airflow C from the outward upper direction to the upper side of the airflow changing devices 180 and 280.

That is, the controller 400 may control the revolutions per minute of the upper fan motor 130 and the revolutions per minute of the lower fan motor 230 such that the direction of the third airflow C is changed from the upper side to the lower side of the airflow changing devices at the predetermined speed in order of (a), (b) and (c) of FIG. 26.

As the first reciprocating operation and the second reciprocating operation are alternately performed, the third airflow C may be discharged while being reciprocated from the upper side to the lower side or from the lower side to the upper side of the airflow changing devices.

In addition, in this case, the first set range and the second set range may be the same, in order to maintain the upward inclination angle and the downward inclination angle of the third airflow C.

In addition, the controller 400 may constantly maintain the RPM change rate of the upper fan motor 130 and the RPM change rate of the lower fan motor 230, in order to constantly maintain the upward and downward reciprocating speeds of the third airflow C discharged from the main body.

In addition, the controller 400 may control the revolution per minute of the lower fan motor 130 and the revolution per minute of the lower fan motor 230 such that the sum of the revolution per minute of the lower fan motor 130 and the revolution per minute of the lower fan motor 230 is equally maintained. In this case, the intensity of the third airflow C discharged from the main body 10 may be constantly maintained.

In addition, as the revolution per minute of the lower fan motor 130 or the revolution per minute of the lower fan motor 230 increases, the discharge intensity of the third airflow C may increase. When the revolution per minute of the lower fan motor 130 and the revolution per minute of the lower fan motor 230 increase, the rotation speeds of the upper fan 120 and the lower fan 220 increase. In contrast, as the revolution per minute of the lower fan motor 130 or the revolution per minute of the lower fan motor 230 decreases, the discharge intensity of the third airflow C may decrease.

For example, the intensity of the third airflow C when the sum of the revolution per minute of the lower fan motor 130 and the revolution per minute of the lower fan motor 230 is 3000 rpm may be twice the intensity of the third airflow C when the sum of the revolution per minute of the lower fan motor 130 and the revolution per minute of the lower fan motor 230 is 1500 rpm. That is, the controller 400 may control the discharge intensity of the third airflow C, by increasing or decreasing the revolution per minute of the lower fan motor 130 and the revolution per minute of the lower fan motor 230.

INDUSTRIAL APPLICABILITY

According to the present invention, a user can adjust the vertical direction of discharged air by controlling the revolutions per minute of the upper or lower fan motor through a controller. Accordingly, the present invention is industrially applicable.

The invention claimed is:

1. A blower comprising:

an upper fan configured to generate a first airflow sucked through an upper suction part and then discharged;

a lower fan provided under the upper fan and configured to generate a second airflow sucked through a lower suction part and then discharged;

an airflow changing device disposed between the upper fan and the lower fan and configured to generate a third airflow obtained by combining the first airflow and the second airflow; and a controller configured to control rotation speeds of the upper fan and the lower fan to adjust a discharge direction of the third airflow, wherein the controller adjusts a vertical discharge direction of the third airflow.

2. The blower according to claim 1, wherein the controller controls the rotation speed of the lower fan to be greater than the rotation speed of the upper fan to direct the third airflow to the upper side of the airflow changing device.

3. The blower according to claim 1, wherein the controller controls the rotation speed of the upper fan to be greater than the rotation speed of the lower fan to direct the third airflow to the lower side of the airflow changing device.

4. The blower according to claim 1, further comprising:

a first discharge part disposed at an outlet side of the upper fan, the first discharge part having a first discharge port, through which the first airflow is discharged to the airflow changing device; and a second discharge part disposed at an outlet side of the lower fan, the second discharge part having a second discharge port, through which the second airflow is discharged to the airflow changing device.

5. The blower according to claim 4, wherein the first discharge port and the second discharge port are rotatable in a circumferential direction.

6. The blower according to claim 5, wherein the third airflow is generated when the first discharge port and the second discharge port are aligned in a vertical direction.

7. The blower according to claim 1, further comprising:

an upper fan motor connected to the upper fan; and a lower fan motor connected to the lower fan, wherein the controller controls revolutions per minute of the upper fan motor and revolutions per minute of the lower fan motor to adjust the vertical discharge direction of the third airflow.

8. The blower according to claim 7, wherein the controller controls the revolutions per minute of the upper fan motor to be greater than the revolutions per minute of the lower fan motor, such that the discharge direction of the third airflow is directed to the upper side of the airflow changing device.

9. The blower according to claim 7, wherein the controller controls the revolutions per minute of the lower fan motor to be greater than the revolutions per minute of the upper fan motor, such that the discharge direction of the third airflow is directed to the lower side of the airflow changing device.

10. The blower according to claim 7, wherein the controller is capable of increasing or decreasing the revolutions per minute of the upper fan motor at a constant speed within a first set range.

11. The blower according to claim 10, wherein the controller is capable of increasing or decreasing the revolutions per minute of the lower fan motor at a constant speed within a second set range.

12. The blower according to claim 11, wherein the first set range and the second set range form the same range.

13. The blower according to claim 12, wherein the controller increases or decreases the revolutions per minute of the upper fan motor and the revolutions per minute of the lower fan motor to be inversely proportional to each other, such that the third airflow is discharged while reciprocating between the upper and lower sides of the airflow changing device.

14. The blower according to claim 13, wherein a sum of the revolutions per minute of the upper fan motor and the revolutions per minute of the lower fan motor is constant.

15. The blower according to claim 14, wherein the controller performs control such that the third airflow is discharged from the upper side to the lower side of the airflow changing device, by a first reciprocating operation of increasing the revolutions per minute of the upper fan motor at a constant speed and decreasing the revolutions per minute of the lower fan motor at a constant speed.

16. The blower according to claim 15, wherein the controller performs control such that the third airflow is discharged from the lower side to the upper side of the airflow changing device, by a second reciprocating operation of decreasing the revolutions per minute of the upper fan motor at a constant speed and increasing the revolutions per minute of the lower fan motor at a constant speed.

17. The blower according to claim 16, wherein the first reciprocating operation and the second reciprocating operation are alternately performed.

18. The blower according to claim 7, wherein, as the revolutions per minute of the upper fan motor or the revolutions per minute of the lower fan motor increases, a discharge intensity of the third airflow increases.

19. The blower according to claim 1, further comprising a support device that supports a main body to be spaced apart upwardly from the ground at a predetermined distance.

20. A blower comprising:

an upper fan configured to generate a first airflow sucked through an upper suction part and then discharged;

a lower fan provided under the upper fan and configured to generate a second airflow sucked through a lower suction part and then discharged;

an airflow changing device disposed between the upper fan and the lower fan and configured to generate a third airflow obtained by combining the first airflow and the second airflow;

a controller configured to control rotation speeds of the upper fan and the lower fan to adjust a discharge direction of the third airflow;

a first discharge part disposed at an outlet side of the upper fan, the first discharge part having a first discharge port, through which the first airflow is discharged to the airflow changing device; and a second discharge part disposed at an outlet side of the lower fan, the second discharge part having a second discharge port, through which the second airflow is discharged to the airflow changing device.

* * * * *